US007702253B2

(12) United States Patent
Nishimura

(10) Patent No.: US 7,702,253 B2
(45) Date of Patent: Apr. 20, 2010

(54) PROCESS CARTRIDGE AND IMAGE FORMING APPARATUS

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 840 days.

(21) Appl. No.: 11/065,123

(22) Filed: Feb. 24, 2005

(65) Prior Publication Data

US 2005/0191089 A1 Sep. 1, 2005

(30) Foreign Application Priority Data

Feb. 27, 2004 (JP) ..... 2004-053104

(51) Int. Cl.
*G03G 15/02* (2006.01)

(52) U.S. Cl. ..... 399/116; 399/111; 399/113; 399/117

(58) Field of Classification Search ..... 399/111, 399/116, 117, 113
See application file for complete search history.

(56) References Cited

U.S. PATENT DOCUMENTS 5,068,691 A * 11/1991 Nishio et al. ..... 399/284
5,218,405 A * 6/1993 Wong ..... 399/117
5,486,898 A 1/1996 Fujii et al.
6,384,940 B1 5/2002 Kawai et al.
2002/0044305 A1 4/2002 Kawai et al.

FOREIGN PATENT DOCUMENTS

JP 60-140264 7/1985
JP 5-297649 11/1993
JP A-07-152302 6/1995
JP 10-39560 2/1998
JP A-10-293516 11/1998
JP A-2001-117375 4/2001
JP 2004177525 A * 6/2004

* cited by examiner

*Primary Examiner*—David P Porta
*Assistant Examiner*—Bryan P Ready
(74) *Attorney, Agent, or Firm*—Oliff & Berridge, PLC

(57) ABSTRACT

A process cartridge including a main frame including a first side wall and a second side wall, and an image carrying member supported by the first side wall and the second side wall in a manner that permits the image carrying member to rotate. The image carrying member is movable between a retracted position and an extended position. When viewed from the first side wall side or the second side wall side, the image carrying member is concealed by the first side wall or the second side wall in the retracted position. When viewed from the first side wall side or the second side wall side, at least a portion of the image carrying member extends beyond a periphery of the first side wall or the second side wall in the extended position.

40 Claims, 9 Drawing Sheets

PROCESS CARTRIDGE AND IMAGE FORMING APPARATUS

CROSS-REFERENCE TO RELATED APPLICATION

This application claims priority from JP 2004-053104, filed Feb. 27, 2004, the subject matter of which is incorporated herein by reference in its entirety.

BACKGROUND

Japanese Laid-Open Patent Publication No. 10-39560, for example, discloses an image forming apparatus, such as a laser printer, wherein a process cartridge, which is detachably attachable to an image forming apparatus, has a photosensitive drum for carrying a toner image. The image forming apparatus has a transfer roller for transferring the toner image, being carried on the photosensitive drum, onto a sheet. When the process cartridge is attached to the image forming apparatus, the photosensitive drum contacts the transfer roller to form a nip portion, which is where the toner image, carried by the photosensitive drum, is transferred onto the sheet when a transfer bias is applied to the transfer roller.

By not including the transfer roller in the above-described process cartridge, the size of the process cartridge can be reduced. An image forming apparatus that accommodates such a process cartridge may also have a smaller-sized attaching/detaching opening and/or a smaller-sized attaching/detaching path through which the process cartridge passes during attachment/detachment of the process cartridge to/from the image forming apparatus. As a result, the overall size of the image forming apparatus may also be reduced.

The image forming apparatus disclosed in Japanese Laid-Open Patent Publication No. 10-39560, for example, includes, however, sheet-guiding members that are disposed in the path. When attaching/detaching the process cartridge to/from the image forming apparatus, the process cartridge must be guided along the path such that the photosensitive drum does not interfere with and/or become damaged by the sheet-guiding members. In order to reduce, and preferably prevent, interference between the photosensitive drum and the sheet-guiding members, a space, which is large enough to avoid the sheet-guiding members, needs to be provided in the attaching/detaching opening and the attaching/detaching path. If, however, such a larger space for the attaching/detaching path and/or the attaching/detaching opening must be allocated in the image forming apparatus, the size advantage acquired by providing the transfer roller on the image forming apparatus instead of the process cartridge is reduced and/or lost.

SUMMARY

According to one aspect of the invention, a process cartridge including a main frame including a first side wall and a second side wall, and an image carrying member supported by the first side wall and the second side wall in a manner that permits the image carrying member to rotate is provided. The image carrying member is movable between a retracted position and an extended position. When viewed from the first side wall side or the second side wall side, the image carrying member is concealed by the first side wall or the second side wall in the retracted position. When viewed from the first side wall side or the second side wall side, at least a portion of the image carrying member extends beyond a periphery of the first side wall or the second side wall in the extended position.

According to another aspect of the invention, a process cartridge including a main frame including a first side wall and a second side wall, and an image carrying member is provided. The image carrying member is supported by the first side wall and the second side wall in a manner that permits the image carrying member to rotate. The image carrying member includes a first end projection and a second end projection. The first end projection and the second end projection respectively extend from a first end and a second end of the image carrying member. The first side wall includes a first support opening and the second side wall includes a second support opening. Each support opening supports a respective one of the first end projection and the second end projection. Each of the first support opening and the second support opening has a shape that permits the respective first end projection and second end projection to move between a first position and a second position.

According to another aspect of the invention, an image forming apparatus including a casing that supports a transfer device, and a removable process cartridge is provided. The removable process cartridge includes a first side wall and a second side wall and supports an image carrying member. The image carrying member is in contact with the transfer device when the process cartridge is installed in the casing. The image carrying member is movable between a retracted position and an extended position. When viewed from the first side wall side or the second side wall side, the image carrying member is concealed by the first side wall or the second side wall in the retracted position. When viewed from the first side wall side or the second side wall side, at least a portion of the image carrying member extends beyond a periphery of the first side wall or the second side wall in the extended position. The casing includes an engagement structure that causes the image carrying member to move from the retracted position to the extended position as the process cartridge is installed in the image forming apparatus.

According to another aspect of the invention, an image forming apparatus including a casing that includes an installation path, and a process cartridge that includes a first side wall, a second side wall and an image carrying member is provided. The image carrying member is supported by the first side wall and the second side wall in a manner that permits the image carrying member to rotate. The image carrying member includes a first end projection and a second end projection and the first end projection and the second end projection respectively extend from a first end and a second end of the image carrying member. The first side wall includes a first support opening and the second side wall includes a second support opening. Each support opening supports a respective one of the first end projection and the second end projection. Each of the first support opening and the second support opening has a shape that permits the respective first end projection and the second end projection to move between a first position and a second position. The installation path includes a first guide groove and a second guide groove that guide the respective first end projection and second end projection from the first position to the second position, as the process cartridge is moved along the installation path during installation.

According to another aspect of the invention, a process cartridge including a main frame including a first side wall and a second side wall, and an image carrying member that is supported by the first side wall and the second side wall in a manner that permits the image carrying member to rotate is provided. The image carrying member is movable between a retracted position and an extended position. When the image carrying member is in the retracted position, at least a portion of at least one of the first side wall and the second side wall projects beyond a first pair and a second pair of diametrically opposing points along an outer circumference of a side of the image carrying member. The first pair of diametrically opposing points form a first line that is substantially perpendicular to a second line formed by the second pair of diametrically opposing points. When viewed from the first side wall side or the second side wall side, at least one of the diametrically opposing points of the image carrying member extends beyond a periphery of the first side wall or the second side wall in the extended position.

An image forming apparatus including a casing that supports a transfer device, and a removable process cartridge is provided. The removable process cartridge includes a first side wall and a second side wall and supports an image carrying member. The image carrying member is in contact with the transfer device when the process cartridge is installed in the casing. The image carrying member is movable between a retracted position and an extended position. When viewed from the first side wall side or the second side wall side, at least diametrically opposing points on an outer circumference of the image carrying member, which form a line that is substantially perpendicular to an attachment/detachment path of the image forming apparatus, are concealed by the first side wall or the second side wall in the retracted position. When viewed from the first side wall side or the second side wall side, at least one of the diametrically opposing points of the image carrying member extends beyond a periphery of the first side wall or the second side wall in the extended position. The casing includes an engagement structure that causes the image carrying member to move from the retracted position to the extended position as the process cartridge is installed in the image forming apparatus.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Throughout the following description, numerous specific concepts and structures are set forth in order to provide a thorough understanding of the invention. The invention can be practiced without utilizing all of these specific concepts and structures. In other instances, well known elements have not been shown or described in detail, so that emphasis can be focused on the invention.

Figure 1:
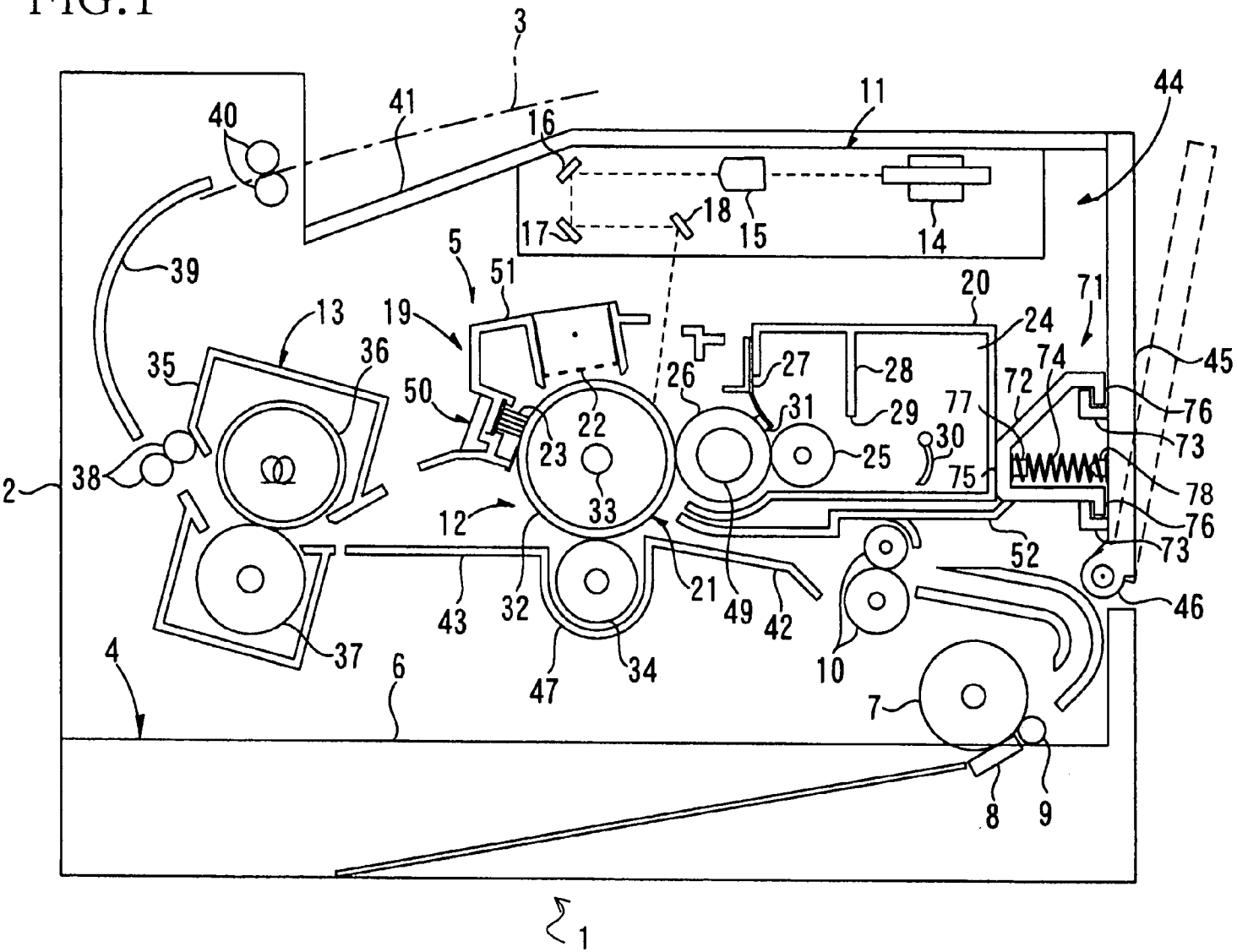
FIG. 1 is a cross sectional view of a portion of an exemplary laser printer, as an image forming apparatus employing one or more aspects of the invention.

Exemplary embodiments of the invention will be described with reference to the accompanying drawings. As shown in FIG. 1, a laser printer 1, as an image forming apparatus, includes a body casing 2, a sheet feeding portion 4 that feeds a sheet 3, as a recording medium, and an image forming portion 5 that forms an image on the fed sheet 3. The sheet feeding portion 4 and the image forming portion 5 are provided in the body casing 2.

An opening or installation/removal path 44, through which a process cartridge 19 (described below) is attached to and detached from the body casing 2, is provided, for example, on one side wall of the body casing 2. For revealing and concealing the opening or installation/removal path 44, a front cover 45, which may function as a nip releasing device is provided.

In the body casing 2, an internal space of the body casing 2, which communicates with the opening 44, serves as a path through which the process cartridge 19 passes or travels during attaching and detaching operations of the process cartridge 19.

The front cover 45 is rotatably attached to the body casing 2 by way of a hinge 46 that is provided at a lower end of the front cover 45. When the front cover 45 is closed by rotating the front cover 45 about the hinge 46, the opening 44 is concealed. When the front cover 45 is opened by rotating the front cover 45 about the hinge 46, the opening 44 is revealed, so that the process cartridge 19 can be attached to and detached from the laser printer 1 through the opening 44.

For ease of discussion, in the following description of the exemplary laser printer 1 and the exemplary process cartridge 19, a side at which the front cover 45 is provided is referred to as the front side, and a side opposite to the front side, at which a fixing portion 13 is provided, is referred to as the rear or back side. The front and rear sides of the process cartridge 19 correspond to the front and rear sides of the laser printer 1 in a state where the process cartridge 19 is attached to the body casing 2. Also, for each of discussion, in the following description of the exemplary laser printer 1 and the exemplary process cartridge 19, a side at which a scanning portion 11 is provided is referred to as the top or upper side, and a side opposite to the top or upper side is referred to as the bottom or lower side. Further, a side will be considered to be the "left side" if it is on the left side when viewing the laser printer from the front of the laser printer and a side will be referred to as the "right side" if it is on the right side when viewing the laser printer from the front of the laser printer. The sides of an attachable/detachable object relative to the laser printer, will be referred to as "left" or "right" based on an orientation of the object when the object is detachably arranged in the laser printer.

A cartridge pressing portion 71, which may function as a nip forming device, is provided on a rear surface of a lower portion of the front cover 45 in order to elastically press a developer cartridge 20 toward a photosensitive drum 21 when the front cover 45 is closed.

The cartridge pressing portion 71 includes a contact member 72, as a first elastic member, latching members 73, and a pressing member 74 (e.g., a spring).

The contact member 72 includes a plate-shaped contact portion 75 and two latching portions 76. The exemplary contact portion 75 protrudes rearward from a lower rear end of the contact member 72 and has a substantially triangular trapezoidal shape when viewed from the side. Front free ends of the contact portion 75 bend downward to form latching portions 76 such that the front free ends of the contact portion 75 have a substantially L-like shape when viewed from the side. A rear pressing member holding portion 77 is provided on a front surface of a rear portion of the contact portion 75, and the rear pressing member holding portion 77 holds one end of the pressing member 74.

Latching members 73 are provided on the rear surface of the front cover 45, at positions opposite to the respective latching portions 76 of the contact member 72 and at a predetermined distance from each other in an up-and-down direction. Each latching member 73 engages/latches with one of the latching portions 76 of the contact member 72. Each of the exemplary latching members 73 has a substantially L-like shape, when viewed from the side, and bends upward so as to freely and movably engage/latch with the one of the exemplary latching portions 76 in the front-and-rear direction. A front pressing member holding portion 78 is provided on the rear surface of the front cover 45, between the upper and lower latching members 73, and the front pressing member holding portion 78 holds the other end of the pressing member 74.

In the cartridge pressing portion 71, one end of the pressing member 74 is held by the rear pressing member holding portion 77 and the other end is held by the front pressing member holding portion 78 while each of the latching portions 76 of the contact member 72 freely and movably engage/latch with the respective latching member 73 in the front-and-rear direction. With this structure, when the front cover 45 is closed, the contact member 72 is urged rearward at all times by an urging force from the pressing member 74.

Figure 6:
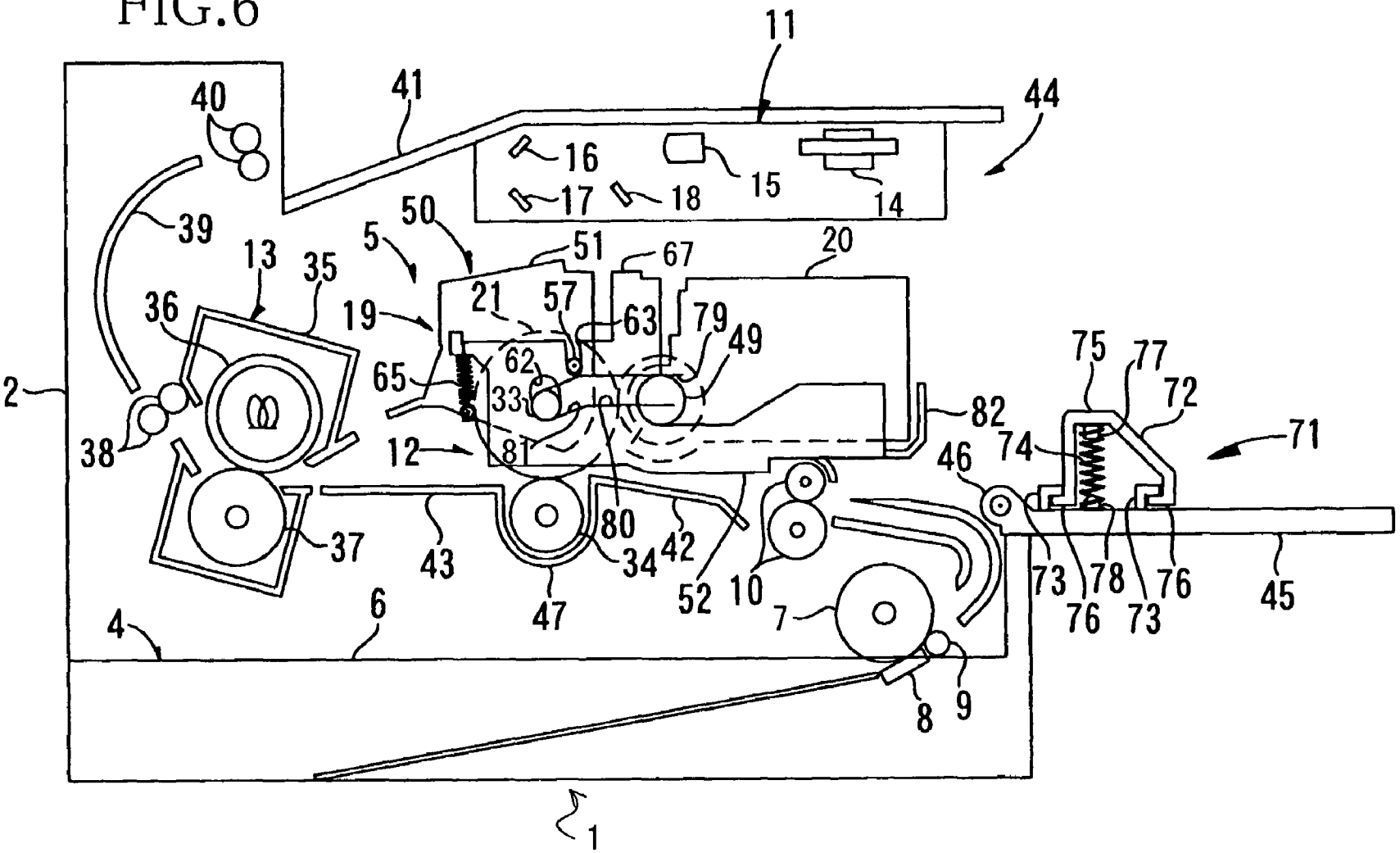
FIG. 6 is a cross sectional view of the laser printer illustrated in FIG. 1 with a front cover open.
Figure 7:
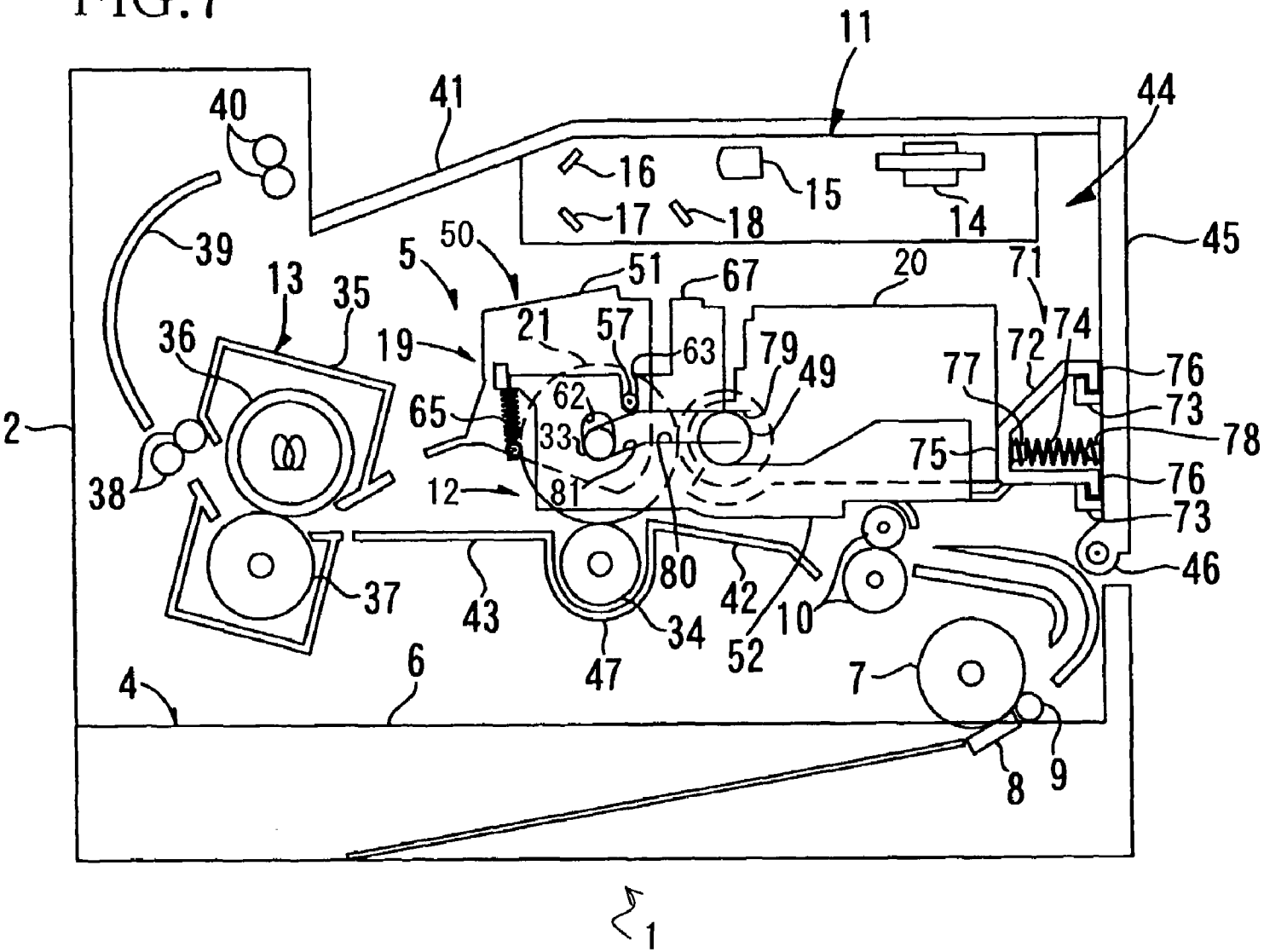
FIG. 7 is a cross sectional view of the laser printer illustrated in FIG. 1 with the front cover closed.

When the front cover 45 is closed and the process cartridge 19 is attached to the body casing 2, the contact portion 75 of the contact member 72 contacts the developer cartridge 20, and thus the developer cartridge 20 is urged rearward by the urging force from the pressing member 74 (FIG. 7). When the front cover 45 is opened, the contact portion 75 of the contact member 72 separates from the developer cartridge 20, and thus the urging force against the developer cartridge 20 by the contact portion 75 of the contact member 72 is released (FIG. 6).

The sheet feeding portion 4 is provided at the bottom of the body casing 2 and includes a sheet cassette 6 for holding a stack of sheets 3 therein, a pick-up roller 7, a separating pad 8, a dust removing roller 9 and a pair of resist rollers 10. The pick-up roller 7 and the separating pad 8 are disposed at a position above a front end of the sheet cassette 6. The dust removing roller 9 is provided downstream of the pick-up roller 7 in a sheet conveying direction and next to and in front of the pick-up roller 7. The pair of resist rollers 10 are provided downstream of the dust removing roller 9 in the sheet conveying direction and at a diagonally-upper-rear position with respect to the dust removing roller 9. The pair of resist rollers 10 include an upper resist roller and a lower rest roller, the upper resist roller is provided such that it is arranged above the lower roller. The upper resist roller 10 is rotatably supported by a bottom plate 60 (described below) and the lower resist roller 10 is rotatably supported by the body casing 2.

The pick-up roller 7 and the separating pad 8 are disposed so as to be opposite to each other. The separating pad 8 is pressed against the pick-up roller 7 by a pressing member (e.g., a spring) (not shown) provided below the separating pad 8.

A top-most sheet 3 in the stack of sheets placed in the sheet cassette 6 is pressed against the pick-up roller 7. The top-most sheet 3 is pinched by the pick-up roller 7 and the separating pad 8, and is separated and supplied from the stack, one by one, by the rotation of the pick-up roller 7. The fed sheet 3 then passes the dust removing roller 9, so that paper dust adhering to the sheet 3 may be removed from the sheet 3. The sheet 3 is then further conveyed to the pair of resist rollers 10. The resist rollers 10 further feed the sheet 3 to an image transfer position (which is provided between n the photosensitive drum 21 and the transfer roller 34 and is where a toner image formed on the photosensitive drum 21 is transferred onto the sheet 3) of the image forming portion 5.

The image forming portion 5 includes the scanning portion 11, a processing portion 12, and the fixing portion 13.

The scanning portion 11 is provided at the upper portion of the body casing 2, and includes a laser emitting portion (not shown), a rotatable polygon mirror 14, a lens 15 and three reflectors 16, 17, 18. A laser beam, which is emitted from the laser emitting portion based on image data, passes or reflects off the polygon mirror 14, the lens 15, the reflector 16, the reflector 17 and the reflector 18 in this order, and finally exposes a surface of the photosensitive drum 21 of the process cartridge 19, as indicated by the dashed line in FIG. 1.

The processing portion 12 includes the process cartridge 19 that is detachably arranged in the body casing 2 and the transfer roller 34 as a transfer device provided in the body casing 2.

Figure 2:
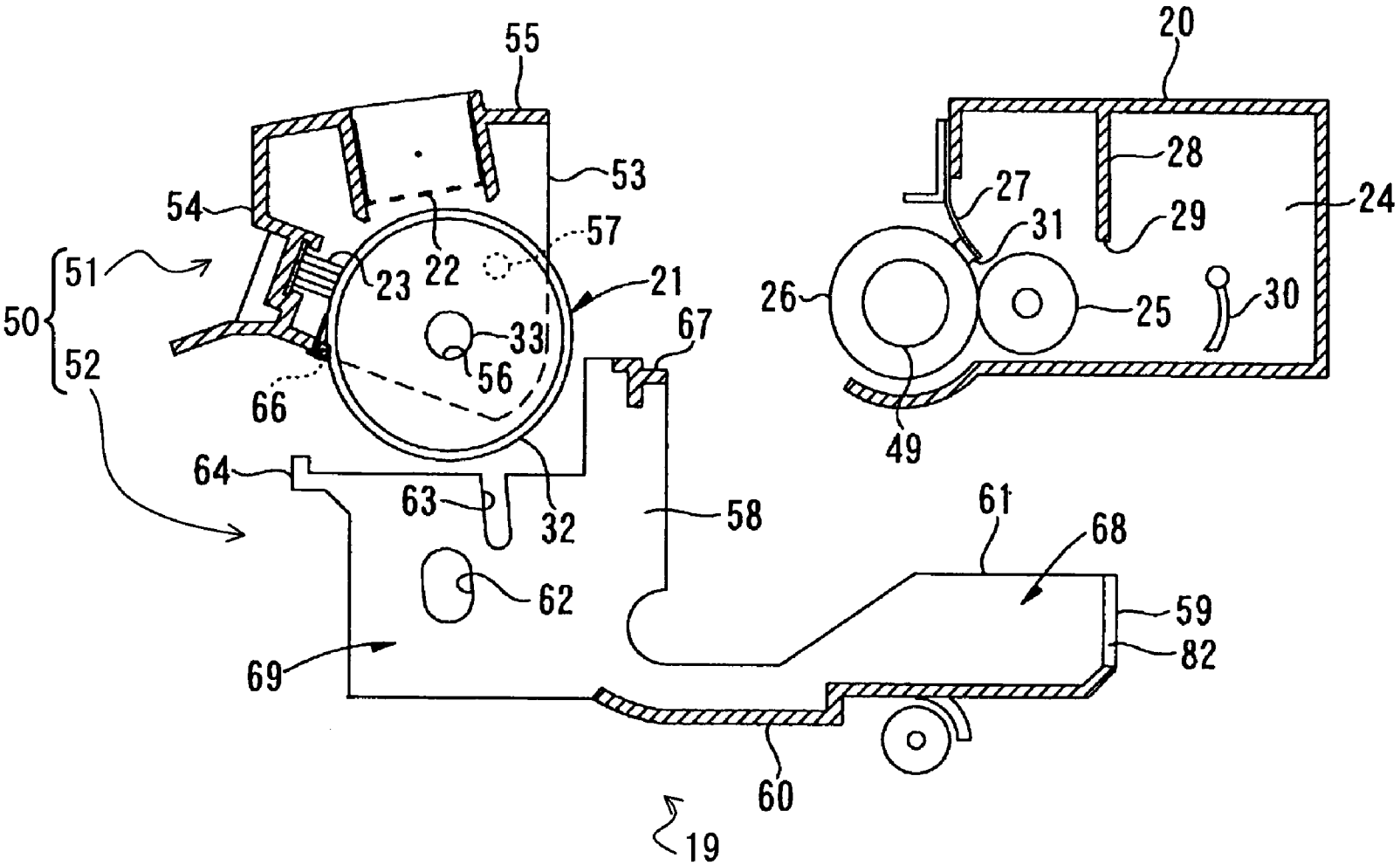
FIG. 2 a cross sectional exploded view of an exemplary process cartridge that may be attachably/detachably employed by the laser printer illustrated in FIG. 1.

When the process cartridge 19 is arranged in the body casing 2, the process cartridge 19 is situated below the scanning portion 11. As shown in FIG. 2, the process cartridge 19 includes a housing 50, the developer cartridge 20 as a casing that is generally detachably accommodated in the housing 50, the photosensitive drum 21 as an image holding body, a scorotron charging device 22 as a charging device, and a cleaning brush 23 as a cleaning device. The housing 50 includes an upper frame 51, as a first frame, and a lower frame 52, as a second frame. As shown in FIG. 2, the upper frame 51 can be attached to or arranged on/above the bottom frame 52.

The upper frame 51 includes a pair of upper side-plates 53, a rear plate 54 and a top plate 55, as shown in FIG. 2. The upper frame 51 has an opening at a top surface thereof, and the bottom and front portions of the frame are open in order to accommodate a portion of the photosensitive drum 21.

The upper side-plates 53 are opposingly disposed so as to sandwich the photosensitive drum 21 between them. Each of the upper side-plates 53 includes a support hole 56 that supports a drum shaft 33 of the photosensitive drum 21, a protrusion 57 as a regulating device that engages with an engagement groove 63 of the lower frame 52, and a spring fixing portion 66 that is attached to one end of a coil tension spring 65 (described below).

The support holes 56 are opposingly provided in lower portions of the respective upper side-plates 53. The protrusions 57, which function as a restricting device, are opposingly provided on relatively front portions of the respective upper side-plates 53. Each protrusion 57 externally protrudes from the respective upper side-plate 53 in a width direction (i.e., a direction in which the upper side-plates 53 face each other). In the following description, this direction will be referred to as a width direction of the process cartridge 19 and the body casing 2. The spring fixing portion 66 is provided on the lower rear portion of each of the upper side-plates 53.

The rear plate 54 is provided on rear edges of the upper side-plates 53. The rear plate 54 extends between the upper side-plates 53. The top plate 55 is provided on upper edges of the upper side-plates 53 and extends between the upper side-plates 53. With this structure, the front and bottom portions of the upper frame 51 are open.

As shown in FIG. 2, the upper frame 51 accommodates the photosensitive drum 21, the scorotron charging device 22 as an acting device, and the cleaning brush 23 therein.

The photosensitive drum 21 includes a cylindrical drum body 32 and the drum shaft 33. The drum shaft 33 functions as a guiding portion that is provided at a center axis of the drum body 32 and which extends in the axis direction. The drum body 32 includes a positively-charged photosensitive layer having, for example, polycarbonate on its outer layer. The drum shaft 33 is inserted into the support holes 56 of the upper side-plates 53.

Figure 3:
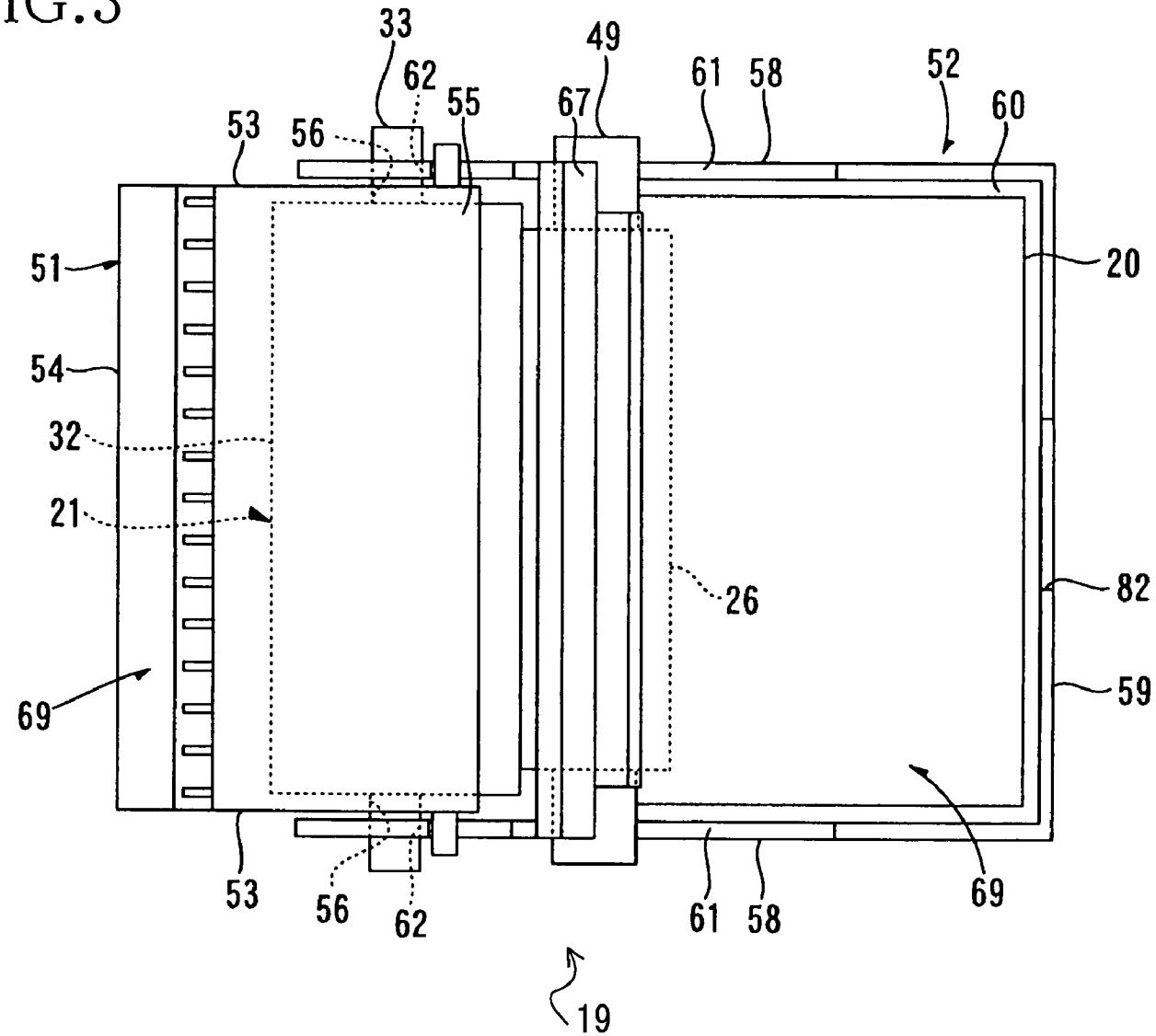
FIG. 3 is a top view of the process cartridge illustrated in FIG. 2.

As shown in FIG. 3, ends of the drum shaft 33 are inserted into the support holes 56 and respective ends of the drum shaft 33 project outward from the support holes 56 of the upper side-plates 53 in the width direction. The drum shaft 33 is electrically connected to ground when the process cartridge 19 is attached to the body casing 2.

In the state where the drum body 32 is rotatably supported by the upper side-plates 53 of the upper frame 51, the front and lower circumference of the drum body 32 project beyond the upper frame 51.

The scorotron charging device 22 is located above the photosensitive drum 21 and is supported by the top plate 55 and such that a predetermined distance exists between the photosensitive drum 21 and the scorotron charging device 22 such that the scorotron charging device 22 does not contact the photosensitive drum 21. The scorotron charging device 22 generates corona discharge from a tungsten charging wire, in order to uniformly positively charge the surface of the photosensitive drum 21.

The cleaning brush 23 is supported by the rear plate 54, behind the photosensitive drum 21. The cleaning brush 23 is arranged such that it faces the photosensitive drum 21 and can be in contact with a peripheral surface of the photosensitive drum 21. The cleaning brush 23 collects paper dust adhering onto the peripheral surface of the photosensitive drum 21 after a developer image is transferred to the sheet 3, as described below.

The lower frame 52 includes a pair of lower side plates 58 as supporting members, a front plate 59, a bottom plate 60 and a bridge plate 67, which, in the exemplary embodiment, are all integrated with each other. When the developer cartridge 20 and the top frame 51 are arranged in/on the lower frame 52, the rear-bottom portion and the rear-side portion of the lower frame 52 are open so as to allow the photosensitive drum 21 to project beyond the lower frame 52 in order to contact the transfer roller 34.

The lower side plates 58 are opposingly provided so as to sandwich the upper frame 51 and the developer cartridge 20 between them in the width direction. Each of the lower side plates 58 has a front part that is generally shorter than the rear part of each lower-side plate 58. The front part receives the developer cartridge 20, and the rear part receives the upper frame 51, as discussed below. A middle part, between the front part and the rear part, includes a tall portion that has a substantially vertically oriented rectangular shape portion and which divides the area defined by the lower frame 52 into the upper frame 51 side and the developer cartridge 20 side. The bridge plate 67 is provided at a top portion of the tall portion between the front and rear parts.

Each of the lower side plates 58 includes a developer cartridge guiding portion 61 on the front part for guiding the developer cartridge 20 during attachment of the developer cartridge 20. The rear part of each side plate 58 includes a shaft receiving portion 62, which movably supports the drum shaft 33 therein, the engagement groove 63 as a restricting device, by which the protrusion 57 of each upper side of the upper frame 51 is engaged, and a spring holding portion 64, which holds the other end of the coil tension spring 65.

The upper edges of the front part of each lower side plates 58 serve as the developer cartridge guiding portions 61. Each of the developer cartridge guiding portions 61 has a front part that substantially flatly extends in a substantially horizontal direction, a middle part that extends at a downward and rearward incline from the rear end of the front part, and a rear part that substantially flatly extends in the substantially horizontal direction. A middle-lower portion of the tall portion of the middle part of each of the lower side plates 58 is cut away from the front to the rear so as to form a substantially semi-circular shape, when viewed from the side. The cut away portions form the rear end portions of the developer cartridge guiding portions 61.

Each of the shaft receiving portions 62 is provided at the substantially middle of the rear part of the lower side-plate 58. Each of the shaft receiving portions 62 is a substantially oval shaped hole extending in the up-and-down direction (in the direction in which the photosensitive drum 21 and the transfer roller 34 oppose each other) and substantially perpendicular to the attaching and detaching direction of the process cartridge 19 (i.e., a substantially horizontal direction) when viewed from the side.

The engagement grooves 63 have a substantially U-like shape and extend downward from the upper edges of the rear parts of the lower side plates 58 at a substantially middle part of the rear part of lower side plates 58 in the front and rear direction. The upper ends of the engagement grooves 63 are open.

The spring holding portions 64 protrude rearward from the upper-rear edges of the rear parts of the lower side plates 58, wherein their free ends have a hook-like portion that bends upward.

The front plate 59 is provided on the front edges of the front part of the lower side plates 58 and the front plate 59 extends between the lower side plates 58. The front plate 59 has an opening 82 (FIG. 3), which has a substantially rectangular shape when viewed from the front. The opening 82 is provided at a substantially middle portion of the front plate 59 in the width direction so that the cartridge pressing portion 71 can contact the developer cartridge 20 by way of the opening 82.

The bottom plate 60 is provided between the lower edges of the lower side plates 58 so as to close the front and middle parts of the lower frame 52. The bottom plate 60 rotatably supports the upper resist roller 10 on an outer-bottom surface thereof.

The bridge plate 67 has a substantially narrow rectangular shape and is provided on the upper edges of the tall substantially middle part of the lower side plates 58 so as to extend between the lower side plates 58 (FIG. 3).

With this structure, the lower frame 52 is divided by the bridge plate 67 into the front part that serves as a cartridge accommodating portion 68 for accommodating the developer cartridge 20 and the rear part that serves as an upper frame support portion 69 for supporting the upper frame 51. The upper and rear portions of the cartridge accommodating portion 68 are open when the developer cartridge 20 is not accommodated therein. The upper, lower, front and rear portions of the upper frame support portion 69 are open such that the upper frame 51 including the photosensitive drum 21 can be received by the lower frame 52 and such that when the is upper frame 51 and the lower frame 52 are engaged, the photosensitive drum 21 can interact, as necessary, with other components of the developer cartridge 20, laser printer 1 and/or process cartridge 19.

The developer cartridge 20 has a box-like shape with an open rear portion. The developer cartridge 20 is detachably accommodated in the cartridge accommodating portion 68 of the lower frame 52. The developer cartridge 20 includes a toner storage chamber 24, a toner supply roller 25, a developer roller 26 and a layer thickness regulating member 27.

The toner storage chamber 24 is an internal space provided at the front part of the developer cartridge 20, as defined by a partition 28. A toner discharge opening 29 is provided under the partition 28 and makes it possible for the front and rear parts of the internal space of developer cartridge, as defined by the partition 28, to communicate with each other. The toner storage chamber 24 stores, for example, positively charged non-magnetic single-component toner, as a developing agent. The toner is, for example, a polymerized toner obtained through co-polymerization of styrene-based monomers, such as styrene, and acryl-based monomers, such as acrylic acid, alkyl (C1-C4) acrylate, alkyl (C1-C4) methacrylate, using a known polymerization method, such as suspension polymerization. The polymerized toner has a substantially spherical shape and has excellent fluidity. Thus, a high quality image can be formed.

A coloring agent, such as carbon black, and wax may be added to the polymerized toner. An external additive, such as silica, may also be added to the polymerized toner to improve the fluidity of the toner. The particle size of the polymerized toner is approximately 6-10 μm.

An agitator 30 is provided in the toner storage chamber 24. The toner stored in the toner storage chamber 24 is agitated by the agitator 30 and is discharged toward the toner supply roller 25 through the toner discharge opening 29 provided under the partition 28.

The toner supply roller 25 is rotatably supported by the developer cartridge 20, and is arranged behind and below the toner discharge opening 29. The toner supply roller 25 includes a metal roller shaft covered with a roller portion made of a conductive foam material. The toner supply roller 25 is driven and rotated by the power supplied from the motor (not shown).

The developer roller 26 is disposed behind the toner supply roller 25 so as to be exposed to the outside from the rear portion of the developer cartridge 20. The developer roller 26 is rotatably supported by the developer cartridge 20 while being in contact with the toner supply roller 25. The developer roller 26 is pressed against the toner supply roller 25 such that toner can be supplied to the developer roller 26. The developer roller 26 includes a metal roller shaft 49 covered with a roller portion made of a conductive rubber material. More specifically, the roller portion of the developer roller 26 is made of a conductive urethane or silicone rubber containing carbon particles and the surface of the developer roller 26 is covered with a coating layer made of a urethane or silicone rubber containing fluorine. A predetermined developing bias is applied to the developer roller 26 during a developing process. The developer roller 26 is also driven by the power from the motor (not shown) and rotated in the same direction as the direction of rotation of the toner supply roller 25. The developer roller 26 is rotatably supported by the developer cartridge 20 so that the roller shaft 49 projects outward from both sides of the developer cartridge 20 in the width direction, as shown in FIG. 3.

The layer thickness regulating member 27 includes a flexible member, made, for example, of metal, and a pressing portion 31 made of an insulative silicone rubber. The pressing portion 31 has, for example, a semi-circular shape in cross section and is provided at a free end of the flexible member. The layer thickness regulating member 27 is situated near the developer roller 26. The pressing portion 31, which is provided at the free end of the flexible member, is pressed against the developer roller 26 by an elastic force of the flexible member.

As discussed above, the developer cartridge 20 is arranged on the cartridge accommodating portion 68 of the lower frame 52 and the upper frame 51 is supported by the upper frame support portions 69 of the lower frame 52.

More specifically, as shown in FIGS. 2 and 3, the developer cartridge 20 is attached to the cartridge accommodating portion 68 by inserting the developer cartridge 20 from the front toward the rear of the cartridge accommodating portion 68. The roller shaft 49 of the developer roller 26 is guided by the cartridge guiding portions 61. More particularly, the roller shaft 49 slides over the cartridge guiding portions 61 until the roller shaft 49 reaches the substantially semi-circular rear ends of the cartridge guiding portions 61. When the developer cartridge 20 is arranged on the lower frame 52, the developer cartridge 20 occupies a space between the lower side plates 58, the front plate 59, and the bottom plate 60.

The drum shaft 33 of the photosensitive drum 21, which is supported by the support holes 56 of the upper side plates 53 of the upper frame 51, is inserted into the shaft receiving portions 62 of the lower side plates 58. In addition, each protrusion 57 of the upper frame 51 engages with a respective engagement groove 63 of one of the lower side plates 58, so that the upper frame 51 is movably supported with respect to the lower frame 52.

Figure 4:
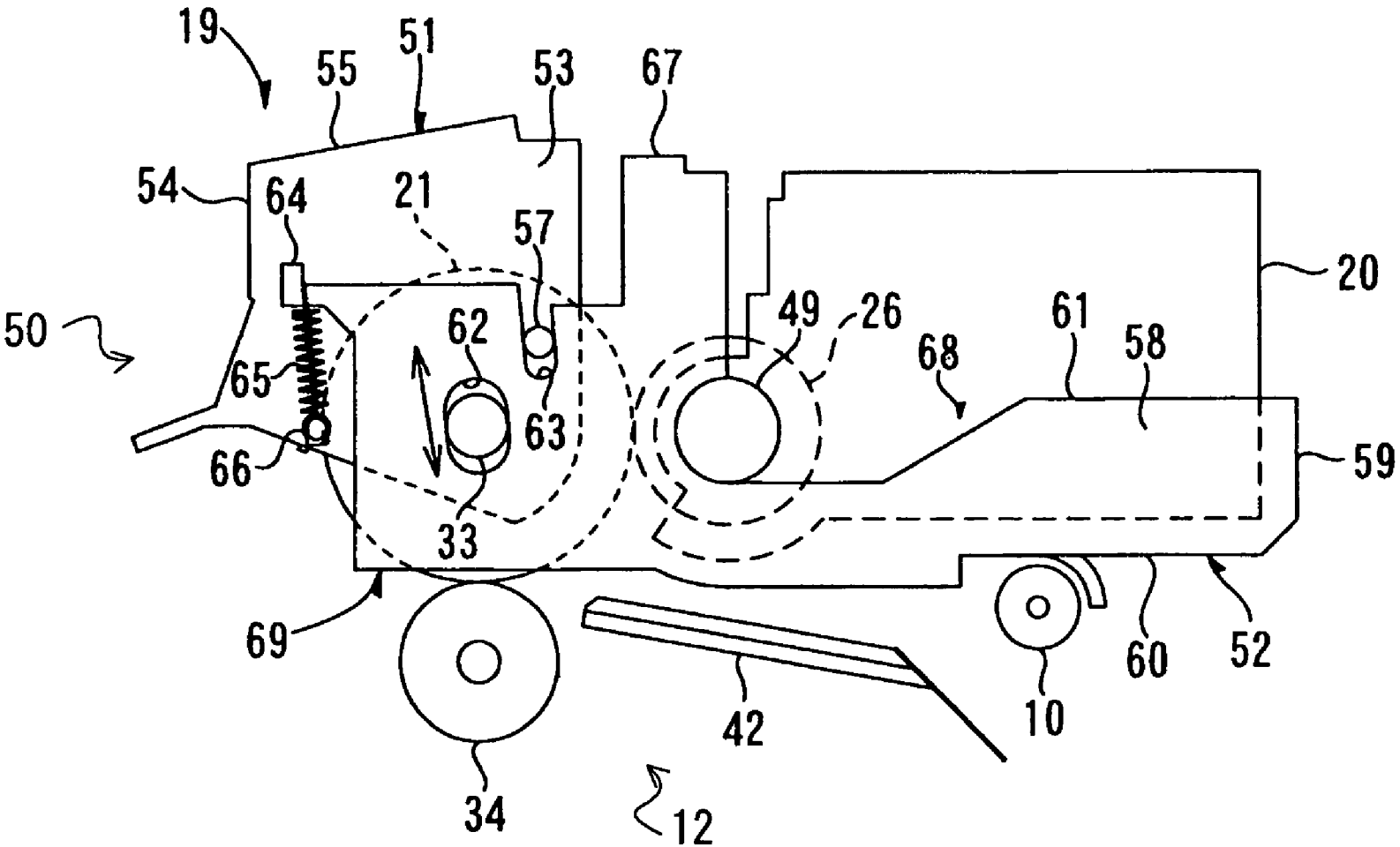
FIG. 4 is a side view of the process cartridge illustrated in FIG. 2 in an attached state.

That is, the upper frame 51 is supported by the lower frame 52 when the drum shaft 33 is inserted into the shaft receiving portions 62 of the lower frame 52. As shown in FIG. 4, the upper frame 51 is supported by the lower side plates 58 such that the upper frame 51 can move together with the photosensitive drum 21 in a substantially up-and-down direction (in a direction indicated by an arrow in FIG. 4) based on the length of the shaft receiving portions 62. The drum shaft 33 extends, in the width direction, from inside the drum body 32 through the support holes 56 and the shaft receiving portions 62 when the drum body 32, the support holes 56 of the upper frame 51 and the shaft receiving portions 62 of the lower frame 52 are all aligned in the width direction. In the state where the photosensitive drum 21 is supported by the lower frame 52, the drum shaft 33 projects outward in the width direction from the shaft receiving portions 62 of the rear part (i.e., upper frame support portion) of the lower side plates 58.

Each of the protrusions 57 of the upper frame 51 engages with the engagement groove 63 of the respective one of the lower side plates 58 so as to be slidable in the substantially up-and-down direction (i.e., direction along which the engagement grooves 63 extend). Thus, the engagement grooves 63 and the shaft receiving portions 62 allow the upper frame 51 and the lower frame 52 to move relative to each other along the direction of extension of the engagement grooves 63 and shaft receiving portions 62, while movement of the upper frame 51 relative to the lower frame 52 in the front-to-back directions is restricted.

As shown in FIG. 4, when the drum shaft 33 is in the extended position (e.g., the drum shaft 33 is in contact with the bottom surface of the shaft receiving portions 62), the bottom portion of the drum body 32 projects out from the bottom surface of the lower frame 52, and is therefore visible when viewed from at least one of the sides facing the lower side plates 58. As discussed above, in the extended position, the drum body 32 projects out from the bottom surface of the lower frame 52 in order to contact the transfer roller 34.

Figure 5:
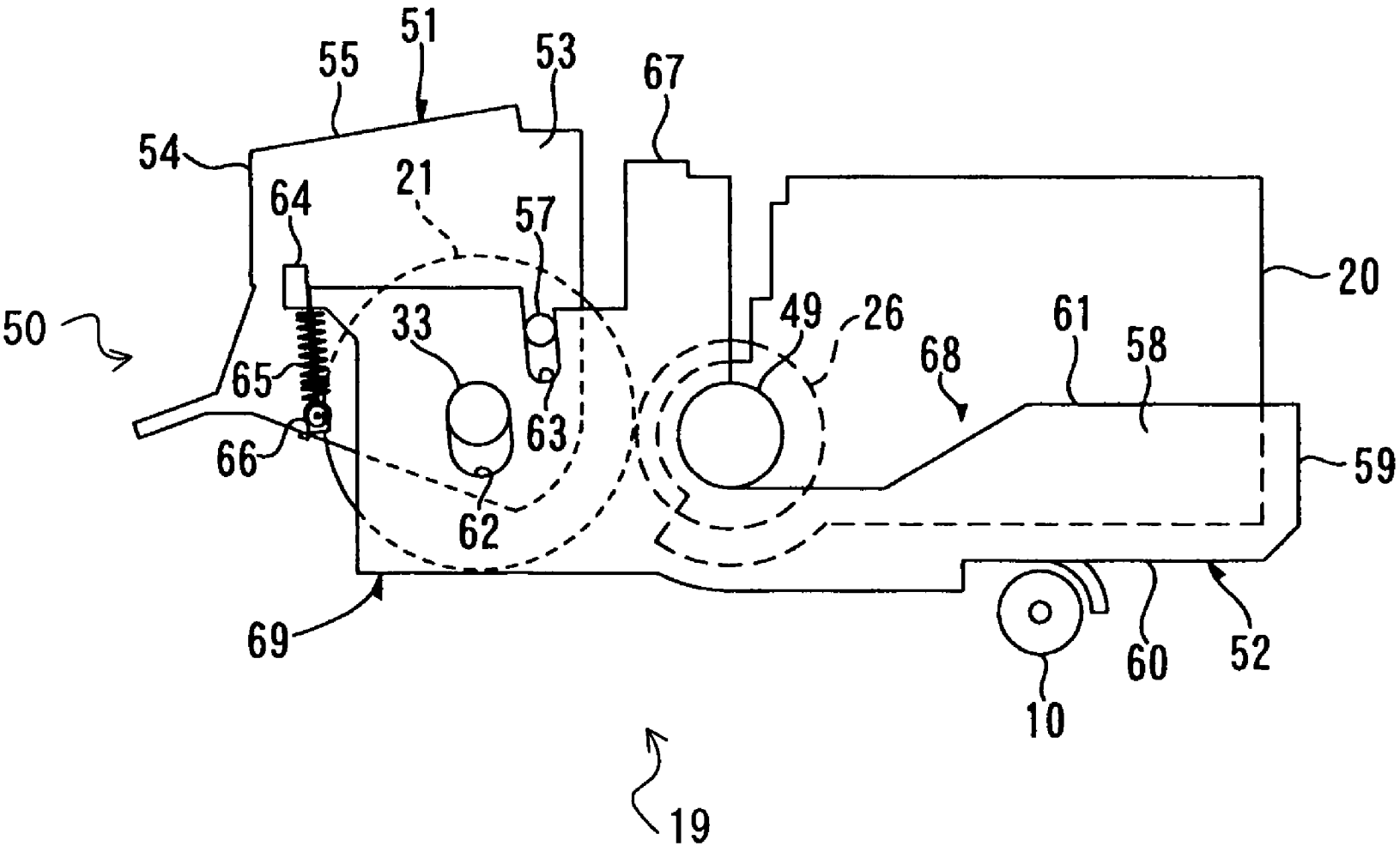
FIG. 5 is a side view of the process cartridge illustrated in FIG. 2 in a detached state.

As shown in FIG. 5, the bottom portion of the drum body 32 is covered with the lower frame 52 in the state where the drum shaft 33 is in the retracted position (e.g., the drum shaft 33 is in contact with the top surface (i.e., top of opening) of the shaft receiving portion 62), when viewed from a side facing one of the lower side plates 58.

To protect the photosensitive drum 21 from damage that may occur due to exposure of the surface of the photosensitive drum 21 during installation/removal and storage of the process cartridge 19, when the process cartridge 19 is not attached to/arranged in the laser printer 1, the drum shaft 33 is maintained in the retracted position such that the frame 50 can help prevent damage to the photosensitive drum 21. In some embodiments, when the drum shaft 33 is in the retracted position (e.g., in contact with the top surface of the shaft receiving portion 62), the frame 50 covers all of the left and right sides of the drum body 32 such that, when viewed from a side facing one of the lower side plates 58, the respective left or right side of the drum body 32 cannot be seen. In some embodiments, when the drum shaft 33 is in the retracted position, the frame 50 extends, from the shaft receiving portions 62, beyond at least the top-most and bottom-most points of the left and right sides of the drum body 32 such that when viewed from one of the sides facing one of the lower side plates 58, the top-most and bottom-most points along the outer circumference of the respective left or right side of the drum body 32 cannot be seen.

In some embodiments, when the drum shaft 33 is in the retracted position, the frame 50 extends, from the shaft receiving portions 62, beyond at least diametrically opposing points, on the outer circumference of the respective left or right side of the drum body 32, which are on a plane that that is substantially perpendicular to the direction along which the process cartridge 20 travels during attachment/detachment of the process cartridge 19 to the laser printer 1, such that when viewed from a side facing one of the lower side plates 58, the diametrically opposing points on the outer circumference of the respective left or right side of the drum body 32 cannot be seen. In some embodiments, when the drum body 32 is in the retracted state, the frame 50 projects beyond at least a portion of the outer circumference of the respective left or right side of the drum body 32 such that if the process cartridge 19, with or without the developer cartridge 20, is placed on a surface, even if a portion of the respective left or right side of the drum body 32 can be seen when the process cartridge is viewed from a side facing one of the lower side plates 58, the drum body 32 does not contact the surface on which the process cartridge 19 was placed. In some embodiments, when the drum body 32 is in the retracted state, at least the top-most, bottom-most, front-most and rear-most points on the outer circumference of the respective left or right side of the drum body 32 are covered by a portion of the frame 50, when viewed from a side facing one of the lower side plates 58.

The drum shaft 33 is moved between the extended position and the retracted position based on the position of the upper frame 51 relative to the lower frame 52. When the upper frame 51 is supported by the lower frame 52, the coil tension spring 65 that functions as the urging device, is provided between the spring fixing portion 66 of the upper frame 51 and the spring holding portion 64 of the lower frame 52, which are disposed substantially opposite to each other in the up-and-down direction. The urging force from the coil tension spring 65 urges the spring fixing portion 66 and the spring holding portion 64 closer to each other, such that the drum shaft 33 is pulled towards the top surfaces of the shaft receiving portions 62. Accordingly, as shown in FIG. 5, when the process cartridge 19 is not arranged in the laser printer 1, the upper frame 51 and the lower frame 52 are pulled away each other and the drum shaft 33 of the photosensitive drum 21, which moves integrally with the upper frame 51 with respect to the lower frame 52, is urged into the retracted position (e.g., contacts the top ends of the shaft receiving portions 62).

As discussed above, when the drum shaft 33 is in the retracted position, when the process cartridge 19 is separated from the body casing 2 and/or no longer in the arranged position, the photosensitive drum 21 is urged toward the interior of the lower frame 52 by the coil tension spring 65, so that, the photosensitive drum 21 can be protected, as discussed above. When the process cartridge 19 is arranged in the laser printer 1, the upper frame 51 and the lower frame 52 are pressed closer together by, for example, an inner member or surface (not shown) of the laser printer 1 along the installation/removal path or opening 44.

As discussed above, in some embodiments, when the process cartridge 19 is attached to the body casing 2, the bottom portion of the drum body 32 is exposed from the lower frame 52 so as to contact the transfer roller 34 (FIG. 4). In this state, the contact position of the drum body 32 of the photosensitive drum 21 with respect to the developer roller 26 is ensured by the cartridge pressing portion 71, which helps position the developer roller 26 with the drum body 32 of the photosensitive drum 21 (FIG. 7). The cartridge pressing portion 71 helps ensure that the developer roller 26 contacts the drum body 32 and, in turn, that the drum body 32 contacts the transfer roller 34 such that the one portion of the drum body 32 is in contact with the developer roller 26 and another portion of the drum body 32 is in contact with the transfer roller 34. The contact between the developer roller 26 and the drum body 32 allows for the developer to be supplied, as necessary, to the photosensitive drum 21 based on the image data and the electrostatic latent image formed on the photosensitive drum 21.

The operation of the process cartridge 19, during an image forming process is described below. The process cartridge is attached to the body casing 2, as described above.

As shown in FIG. 1, in the developer cartridge 20, when toner stored in the toner storage chamber 24 is agitated by the agitator 30, the toner is discharged from the toner discharge opening 29. The toner discharged from the toner discharge opening 29 is then supplied to the developer roller 26 by the rotation of the toner supply roller 25. At that time, the toner is positively charged by the friction generated between the toner supply roller 25 and the developer roller 26. The toner supplied onto the developer roller 26 is sandwiched between the pressing portion 31 of the layer thickness regulating member 27 and the developer roller 26 by the rotation of the developer roller 26, so that the supplied toner becomes a thin layer with a uniform thickness on the developer roller 26.

Meanwhile, the surface of the photosensitive drum 21 is uniformly positively charged by the scorotron charging device 22 in accordance with the rotation of the photosensitive drum 21. The surface of the photosensitive drum 21 is then exposed to a laser beam that is emitted from the scanning portion 11, and an electrostatic latent image, which corresponds to an image to be transferred onto the sheet 3, is formed onto the surface of the photosensitive drum 21.

When the electrostatic latent image on the photosensitive drum 21 faces and contacts the developer roller 26, the positively charged toner, of uniform thickness, held on the developer roller 26 is supplied onto and held by portions of the photosensitive drum 21, which correspond to the formed electrostatic latent image, i.e., portions of the photosensitive drum with a lower potential because of the exposure by the laser beam. Thus, the latent image formed on the photosensitive drum 21 is visualized, and a toner image is formed on the surface of the photosensitive drum 21 by a reverse image developing process.

As discussed above, the transfer roller 34 is provided in the body casing 2. In the state where the process cartridge 19 is attached to the body casing 2, the transfer roller 34 opposes and contacts the photosensitive drum 21 in the substantially up-and-down direction so as to form a nip portion between the transfer roller 34 and the photosensitive drum 21. The nip portion is ensured by the cartridge pressing portion 71, as discussed above. The transfer roller 34 includes a metal roller shaft covered with a roller portion made of a conductive rubber material. A predetermined transfer bias is applied to the transfer roller 34 at the time of transfer of the toner image on the photosensitive drum 21 to the sheet 3. The transfer roller 34 is driven and rotated by the power from a motor (not shown).

The body casing 2 includes a transfer roller cover 47 that covers the transfer roller 34, a front chute 42 as a guiding member that guides the sheet 3 to the transfer roller 34 and a rear chute 43 as a guiding member that is provided behind the front chute 42 and guides the sheet 3 after it is discharged from the transfer roller 34.

The transfer roller cover 47 has a substantially U-like shape such that an upper portion thereof is open. The transfer roller cover 47 extends in the axial direction of the transfer roller 34 and surrounds a lower portion of the transfer roller 34.

The front chute 42 extends in the axial direction of the transfer roller 34, a front portion of the front chute 42 is disposed at a slightly lower level than the rear portion of the front chute 42. The front chute 42 has a plate-like shape extending in the front-and-rear direction. The rear end of the front chute 42 is located at a position on the photosensitive drum 21 side of plane that passes through the nip portion formed between the photosensitive drum 21 and the transfer roller 34. With such a structure, the sheet 3 may be guided by the bottom surface front chute 42 to the nip portion.

The rear chute 43 extends substantially in the front-and-back direction along the axial direction of the transfer roller 34. The rear chute 43 has a plate-like shape extending in the front and rear direction and the rear chute 43 helps guide the sheet 3 that is discharged from the transfer roller 34 to the fixing portion 13.

The toner image held on the surface of the photosensitive drum 21 is transferred, by the transfer bias applied to the transfer roller 34, onto the sheet 3 that is conveyed by the resist rollers 10 to the front chute 42 before being further guided by the bottom surface of the front chute 42 to the transfer position (i.e., the nip portion between the photosensitive drum 21 and the transfer roller 34).

The sheet 3 onto which the toner image is transferred is guided by the rear chute 43 and further conveyed to the fixing portion 13.

Residual toner remaining on the photosensitive drum 21, after the toner image is transferred to the sheet 3, is collected by the developer roller 26. Paper dust adhering to the photosensitive drum 21, after the toner image is transferred to the sheet 3, is collected by the cleaning brush 23.

As shown in FIG. 1, the fixing portion 13 is provided behind the process cartridge 19 and includes a fixing frame 35, a heat roller 36, a pressing roller 37 and a pair of conveyor rollers 38. The heat roller 36, the pressing roller 37 and the pair of conveyor rollers 38 are arranged in the fixing frame 35.

The heat roller 36 includes a metal base tube and a halogen lamp inside the base tube for generating heat. The heat roller 36 is driven and rotated by the power from the motor (not shown).

The pressing roller 37 is opposingly disposed below the heat roller 36 so as to press against the heat roller 36. The pressing roller 37 includes a metal roller shaft covered with a roller portion made of rubber material. The pressing roller 37 rotates by following the rotation of the heat roller 36.

The pair of conveyor rollers 38 are disposed downstream of the heat roller 36 and the pressing roller 37 in the sheet conveying direction.

At the fixing portion 13, the toner transferred onto the sheet 3 at the transfer position is thermally fixed onto the sheet 3 while the sheet 3 passes between the heat roller 36 and the pressing roller 37. The sheet 3 on which the toner is fixed is further conveyed, by the pair of conveyor rollers 38, to a sheet discharge path 39 that extends toward the top of the body casing 2. The sheet 3 conveyed to the sheet discharge path 39 is then discharged, by a pair of sheet discharge rollers 40, onto a sheet discharge tray 41 that is provided at the top of the body casing 2. The pair of sheet discharge rollers 40 are provided above the discharge path 39.

Next, an attaching and detaching operation of the process cartridge 19 with respect to the body casing 2 of the laser printer 1 will be described with reference to FIGS. 6 and 7.

The laser printer 1 is provided with guide grooves 79, that function as a guiding portion for guiding the process cartridge 19 during attachment and detachment of the process cartridge 19 to the body casing 2.

The guide grooves 79 are provided in the inner surfaces of the side walls of the body casing 2. The guide grooves 79 are elongated grooves and the recesses of the guide grooves 79 project outward in the width direction. Each of the guide grooves 79 includes a horizontal path 80 at the front side and an inclined path 81 at the rear side, which together form the continuous guide groove 79.

The horizontal path 80 extends in the substantially horizontal direction in a portion of the laser printer between the scanning portion 11 and the front chute 42 (i.e., at substantially the middle of the body casing 2 in the front-and-rear direction). An upper wall and a lower wall of the horizontal path 80 each extend substantially in the front-and-rear direction and substantially parallel to each other and with a predetermined distance between them. The upstream end of the horizontal path 80 is open and the downstream end of the horizontal path 80 communicates with the inclined path 81.

The inclined path 81 extends in a downward incline with the front portion of the inclined path 81 being higher than a rear portion of the inclined path 81, and the inclined path 81 extends from the downstream end of the horizontal path 80 towards the transfer roller 34. An upper wall and a lower wall of the inclined path 81 each extend in a substantially front and rear direction and substantially parallel to each other a predetermined distance between them. The upstream end of the inclined path 81 communicates with the downstream end of the horizontal path 80. The downstream end of the inclined path 81 has a substantially semi-circular cross-sectional shape, as discussed above, and is disposed such that the drum shaft 33 is located in the downstream end of the inclined path 81 such that the photosensitive drum 21 and the transfer roller 34 are opposite to each other.

As discussed above, each of the guide grooves 79 includes the horizontal path 80 and the inclined path 81 which extends continuously downwardly from the horizontal path 80. With this structure, even when the rear end of the front chute 42 is located on the photosensitive drum 21 side of a plane extending through the nip portion formed between the photosensitive drum 21 and the transfer roller 34, the process cartridge 19 can be attached to and detached from the body casing 2 while easily overpassing the rear end of the front chute 42. Accordingly, interference and/or contact between the front chute 42 and the photosensitive drum 21 can be avoided during attachment and detachment the process cartridge 19 with respect to the body casing 2.

To attach the process cartridge 19 to the body casing 2, as shown in FIG. 6, the front cover 45 is opened to open the opening 44 and then, the process cartridge 19 is inserted into the body casing 2 in a substantially front-and-back horizontal direction. The drum shaft 33 engages with and is guided by the horizontal path 80 in the substantially horizontal direction from the front to the rear. Thus, the process cartridge 19 is moved in the substantially front-and-back horizontal direction. With the movement of the process cartridge 19, along the path defined by the guide grooves 79, the photosensitive drum 21 overpasses the rear end of the front chute 42 without contacting the rear end of the front chute 42.

When the drum shaft 33 reaches the boundary between the horizontal path 80 and the inclined path 81, the drum shaft 33 is engaged with and is guided, from the front to the rear, and downward on the inclined path 81 so as to reach the vicinity of the transfer roller 34. Therefore, the process cartridge 19 is moved downward in the front to rear direction so as to approach the transfer roller 34.

When the drum shaft 33 reaches the downstream ends of the inclined path 81, the process cartridge 19 is in the arranged position within the laser printer 1. The peripheral surface of the photosensitive drum 21 opposingly contacts the transfer roller 34 in the up-and-down direction, thereby forming the nip portion between the photosensitive drum 21 and the transfer roller 34.

When the process cartridge 19 is in the arranged position, the drum shaft 33 abuts against the downstream ends of the inclined path 81, and the upper resist roller 10 supported by the bottom plate 60 contacts the lower resist roller 10 provided to the body casing 2. A power transmission gear for transmitting the power from the motor engages with a drive gear (not shown) of the roller shaft 49 of the developer roller 26 when the process cartridge 19 is at the arranged position. Thus, the lower frame 52 is also at its arranged position within the laser printer 1.

When the drum shaft 33 abuts against the downstream ends of the inclined path 81, the drum shaft 33 is engaged with the semi-circular downstream ends of the guide grooves 79 and is positioned therein. Therefore, the upper frame 51 is also in its arranged position within the laser printer 1.

When the process cartridge 19 is in the arranged position, as discussed above, the drum shaft 33 is moved to the retracted position (e.g., the drum shaft contacts the bottom ends of the shaft receiving portions 62), against the urging force from the coil tension spring 65 by, for example, a height of the installation/removal path of the process cartridge 19 such that the upper frame 51 and the lower frame 52 are pressed closer together in order for the process cartridge 19 to fit within the installation/removal path or opening 44. Therefore, the lower portion of the photosensitive drum 21 is exposed from the lower portion of the lower frame 52, when viewed from the side, and the nip portion is formed between the photosensitive drum 21 and the transfer roller 34.

Then, when the opening 44 is concealed by closing the front cover 45, as shown in FIG. 7, the contact portion 75 of the contact member 72 of the pressing portion 71 contacts the developer cartridge 20 and presses the developer cartridge 20 rearward by the urging force from the pressing member 74. Thus, the developer roller 26 is pressed against the drum body 32 of the photosensitive drum 21, thereby further establishing the nip portion between the developer roller 26 and photosensitive drum 21.

To remove the process cartridge 19 from the body casing 2, as shown in FIG. 6, the front cover 45 is opened to reveal the opening 44. When the front cover is open, the contact portion 75 of the contact member 72 of the cartridge pressing portion 71 separates from the developer cartridge 20 and releases the pressing of the developer cartridge 20 against the drum body 32, which is achieved by the urging force from the pressing member 74.

When the process cartridge 19 is in the arranged position in the laser printer 1, to remove the process cartridge 19 therefrom, the drum shaft 33 is guided first by the inclined path 81 and then by the horizontal path 80. Accordingly, the process cartridge 19 moves from the rear to the front substantially in the horizontal direction and such that the photosensitive drum 21 overpasses the rear end of the front chute 42 without contacting the rear end of the front chute 42.

After passing the horizontal path 80, the drum shaft 33 separates from the horizontal path 80 and the process cartridge 19 can be removed from the body casing 2.

When the process cartridge is not arranged in the laser printer 1, the upper frame 51 and the lower frame 52 of the process cartridge 19 are pulled away from each other by the urging force from the coil tension spring 65, so that, as described above, the drum shaft 33 of the photosensitive drum 21, which moves integrally with the upper frame 51, contacts the top ends of the shaft receiving portions 62. Therefore, in the state where the process cartridge 19 is separated from the body casing 2, the photosensitive drum 21 is urged toward the interior of the lower frame 52. As discussed above, when the drum shaft 33 is in the retracted position, when the process cartridge 19 is separated from the body casing 2 and/or no longer in the arranged position, the photosensitive drum 21 is urged toward the interior of the lower frame 52 by the coil tension spring 65, so that, the photosensitive drum 21 can be protected, as discussed above.

In the attaching and detaching operations of the exemplary process cartridge 19, the drum shaft 33 can move in the up-and-down directions in the shaft receiving portions 62, so that the photosensitive drum 21 can also move in the up-and-down directions. Therefore, the interference between the photosensitive drum 21 and the other members disposed along the installation/removal path or opening 44 of the process cartridge 19 can be avoided by the up-and-down movement of the photosensitive drum 21, relative to the lower frame 52 during the attaching and detaching operations. Further, in comparison to a size of an opening and an installation/removal path of an image forming apparatus employing a process cartridge with a photosensitive drum that cannot move in the up-and-down directions relative to the process cartridge, image forming apparatus employing one or more aspects of the invention and allowing the photosensitive drum 21 to move up and down based, for example, on the retracted or extended state of the drum shaft 33, make it easier to downsize the installation/removal path and opening 44 in the up-and-down direction. As a result, the process cartridge 19 can be attached to and detached from the body casing 2 while requiring a smaller amount of space in the laser printer 1. Thus, a size of the laser printer may also be reduced.

In the process cartridge 19, the drum shaft 33 of the photosensitive drum 21 is held by the elongated holes of the shaft receiving portions 62 so as to be movable in the substantially up-and-down directions, so that the photosensitive drum 21 can be easily moved with a simple structure in order to help protect the photosensitive drum from damage when the process cartridge is removed from the laser printer 1.

In addition, the shaft receiving portions 62 are elongated holes extending in the up-and-down direction, so that the photosensitive drum 21 can move in a direction substantially perpendicular to the horizontal direction, (i.e., the general attaching and detaching direction of the process cartridge 19). Therefore, the interference or contact between members disposed along the path and the photosensitive drum 21 can be further easily prevented. In addition, the installation/removal path or opening 44 can be reduced in size in the substantially up-and-down direction.

In the process cartridge 19, the photosensitive drum 21 is supported by the lower frame 52 so as integrally move with the upper frame 51. That is, the photosensitive drum 21 moves with the upper frame 51. Therefore, 50 in comparison to a case where only the photosensitive drum 21 moves, a space for moving the photosensitive drum 21 need not be provided in the housing. Accordingly, a size of the process cartridge 19 can also be reduced.

As discussed above, the scorotron charging device 22 and the cleaning brush 23 are provided on the upper frame 51. Thus, because the photosensitive drum 21 does not move relative to the upper frame 52, the precise relative positional relationship between the scorotron charging device 22, the cleaning brush 23 and the photosensitive drum 21 can be maintained. It is thereby ensured, that at least based on the positional relationship, the photosensitive drum 21 can be charged by the scorotron charging device 22, and the photosensitive drum 21 can be cleaned by the cleaning brush 23.

The rotation of the upper frame 51 with respect to the lower frame 52 can also be restricted by the engagement of the protrusions 57 of the upper frame 51 with the respective engagement grooves 63 of the lower frame 52. Accordingly, the posture of the upper frame 51 with respect to the lower frame 52 can be maintained, so that the process cartridge 19 can be attached to and detached from the body casing 2.

In the state where the process cartridge 19 is detached from the body casing 2, as discussed above, the photosensitive drum 21 is urged toward the interior of the upper frame 51 by the coil tension spring 65, and thus, as discussed above, in some embodiments, the entire drum body 32 of the photosensitive drum 21 is covered by the frame 50, when viewed from either of the sides of the frame defined by the side plates 53, 58 (e.g., the frame 50 overlaps the respective side of the drum body 32). Therefore, in the state where the process cartridge 19 is separated from the body casing 2, damage to the photosensitive drum 21 can be reduced, and preferably prevented, by, for example, reducing the chance of the photosensitive drum 21 undesirably contacting another surface, while still allowing for the size of the process cartridge 19 to be reduced. In addition, in the body casing 2, the opening 44 and the installation/removal path can be reduced in size.

When the process cartridge 19 is attached to and detached from the body casing 2, as discussed above, the drum shaft 33 of the photosensitive drum 21 is guided by the guide grooves 79 provided to the body casing 2, so that the process cartridge 19 can be easily attached to and detached from the body casing 2. The drum shaft 33 is guided based on the engagement of the drum shaft 33 of the photosensitive drum 21 and the guide grooves 79, so that the process cartridge 19 can be easily attached to and detached from the body casing 2.

In addition, as discussed above, the guide grooves 79 have a substantially upside-down V-like shape when viewed from the sides 53, 58 because each of the guide grooves 79 includes the horizontal path 80 and the inclined path 81 that extends continuously downwardly from the horizontal path 80, so that the photosensitive drum 21 can pass over the rear end of the front chute 42 during the attachment and detachment of the process cartridge 19 without interference therewith. Also, the sheet 3 can be guided by the bottom surface of front chute 42 to the nip position between the photosensitive drum 21 and the transfer roller 34. In addition, the process cartridge 19 can be attached to and detached from the body casing 2 while interference or contact between the front chute 42 and the photosensitive drum 21 is avoided.

The laser printer 1 employing one or more aspects of the invention, can be equipped with an attachable/detachable process cartridge 19, which can be attached to the body casing 2 and which requires less space inside the laser printer 1. Therefore, the laser printer 1 can also be downsized.

In the state where the process cartridge 19 is attached to the body casing 2, when the front cover 45 is open, the contact member 72 of the cartridge pressing portion 71 is separated from the developer cartridge 20 and is in an uncontacted state such that the nip portion between the photosensitive drum 21 and the developer roller 26 can be released. When the process cartridge 19 is to be attached to and detached from the laser printer 1, the nip portion is released by, for example, opening the front cover 45, so that the photosensitive drum 21 can be moved. When the front cover 45 is closed, the contact member 72 of the cartridge pressing portion 71 contacts the developer cartridge 20, so that the developer roller 26 is pressed against the photosensitive drum 21. Thus, a developer image can be formed by the supplied toner adhering to the laser-beam exposed portions (i.e., lower potential portions) of the photosensitive drum 21. As described above, when the opening and closing of the front cover 45 is synchronized with the pressing and separating of the contact member 72, proper functioning of the laser printer 1 can be increased by, for example, ensuring that the photosensitive drum 21 is in contact with both the developer roller 26 and the transfer roller 34.

In the above-described exemplary embodiment, the cartridge pressing portion 71 is provided on the front cover 45. In some embodiments, however, the cartridge pressing portion 71 may be provided on the process cartridge 19, as shown in FIGS. 8 and 9.

Figure 8:
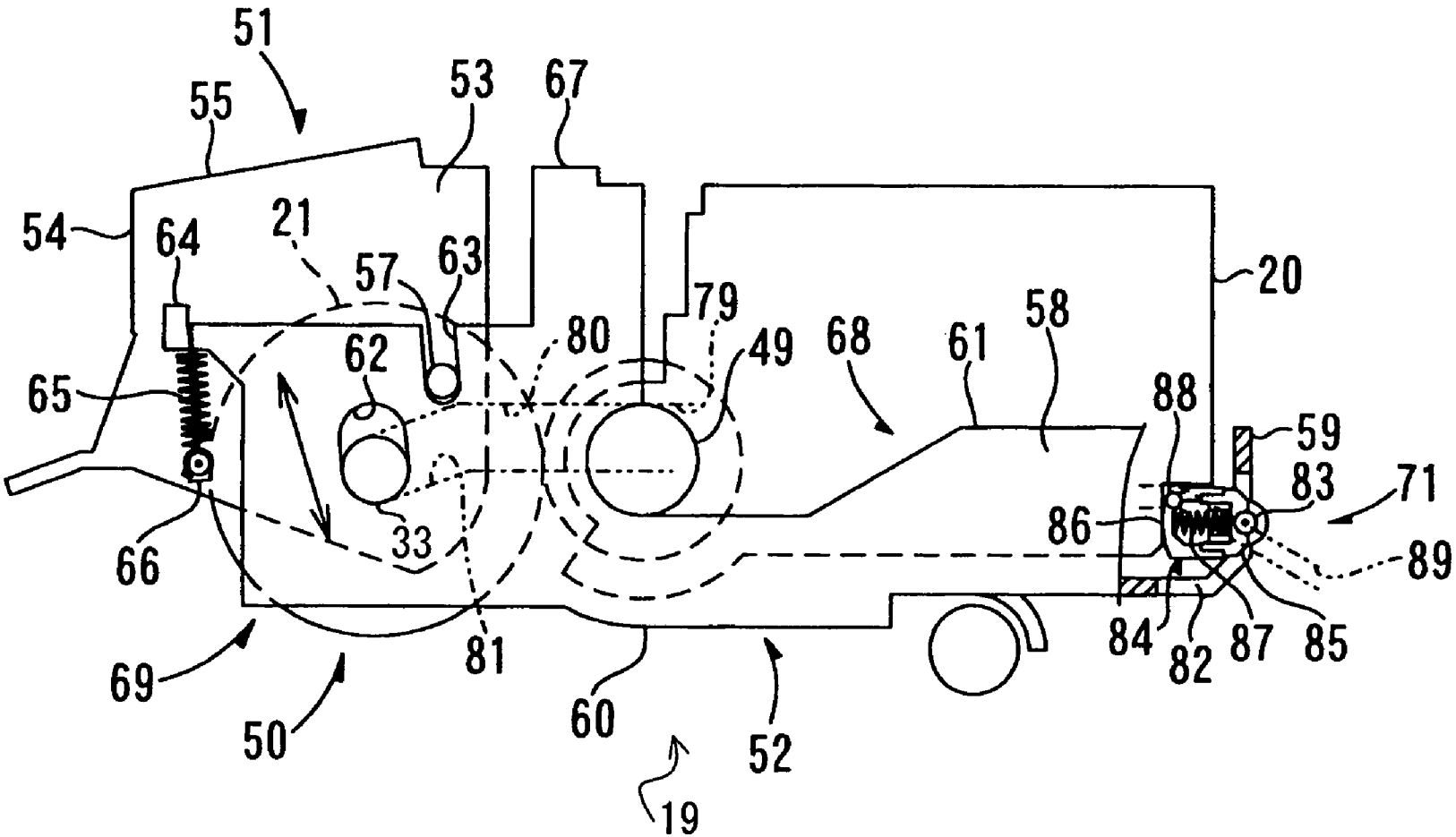
FIG. 8 is a side view of another exemplary process cartridge employing one or more aspects of the invention in an attached state, where a cartridge pressing portion is provided on the process cartridge.
Figure 9:
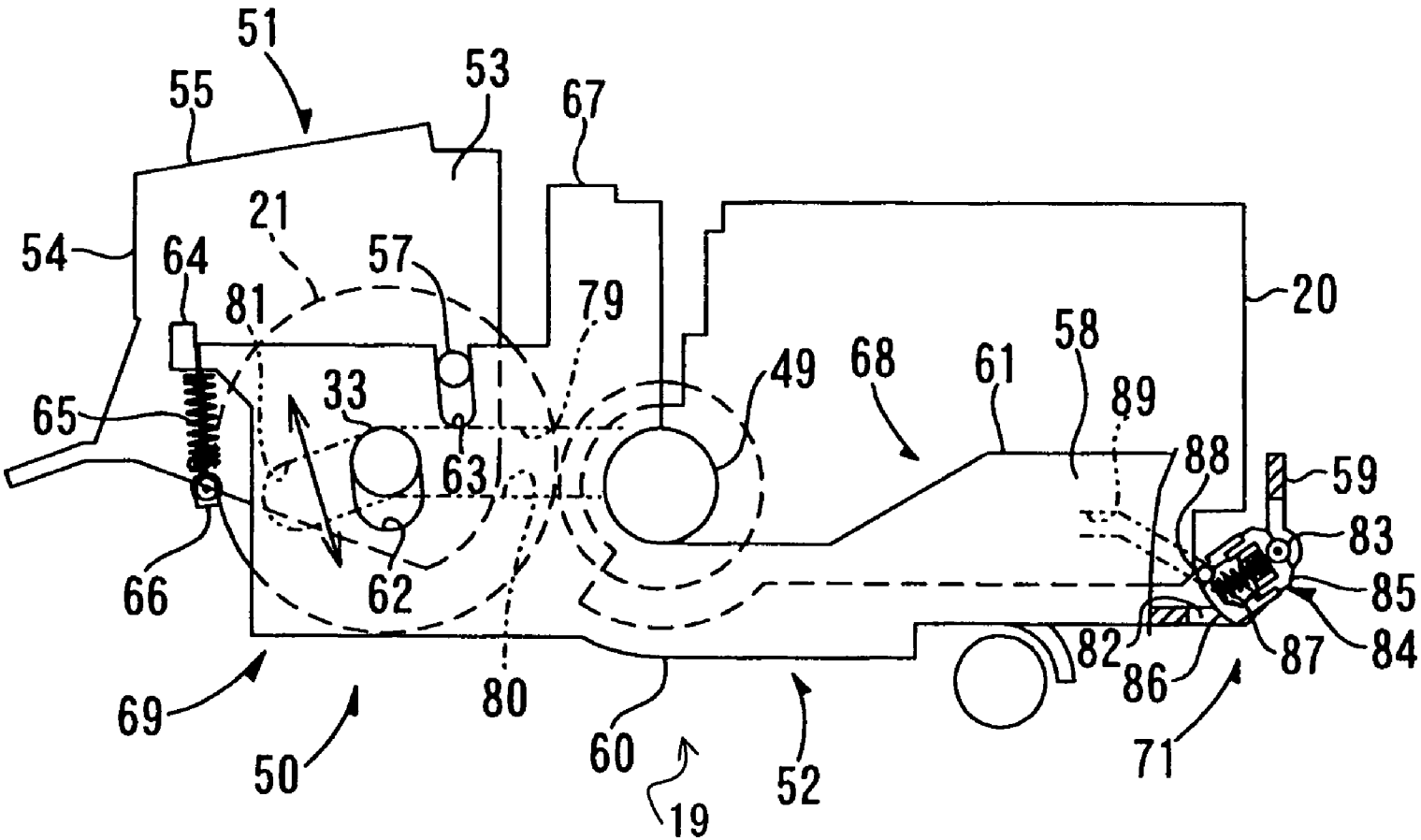
FIG. 9 is a side view of the process cartridge of FIG. 8 in a detached state.

In FIG. 8, the cartridge pressing portion 71 is provided to the front plate 59 of the lower frame 52.

In this exemplary embodiment, the cartridge pressing portion 71 includes a rotating shaft 83 and a rotating member 84, as a second elastic member.

The rotating shaft 83 is provided so as to extend in the width direction of an opening 82 of the front plate 59.

The rotating member 84 includes a support member 85, a contact member 86 and a compression spring 87. The support member 85 has a substantially C-shape in cross section and is rotatably supported by the rotating shaft 83. The contact member 86 also has a substantially C-shape in cross section and can engage with the support member 85. The contact member 86 has a boss 88 at its rear end portion. The boss 88 protrudes outward in the width direction to engage a contact guide groove 89 (FIG. 9). The contact member 86 is engaged with the support member 85 so as to be movable toward and away from the support member 85. The contact member 86 and the support member 85 are engaged with each other to form the rotating member 84, which has, for example, a rectangular shaped frame in cross section. The compression spring 87 is interposed between the contact member 86 and the support member 85 so as to rearwardly urge the contact member 86 at all times.

In addition to the guide grooves 79, in some exemplary embodiments, the contact guide groove 89 is provided in the body casing 2 in order to guide the boss 88 of the rotating member 84.

The rear end of the contact guide groove 89 is disposed such that the rotating member 84 is oriented substantially in the horizontal direction and the contact member 86 contacts the lower front end of the developer cartridge 20 in the state where the process cartridge 19 is attached to the body casing 2. In some exemplary embodiments, the lower front end of the developer cartridge 20 has a stepped or cut out portion with the recess portion thereof facing frontward so that the contact member 86 can be accommodated therein.

The contact guide groove 89 extends frontward substantially in the horizontal direction from its rear end and is inclined downward towards the front end thereof.

As shown in FIG. 8, in the state where the process cartridge 19 is attached to the body casing 2, the boss 88 is positioned at the front end portion of the contact guide groove 89 and the rotating member 84 is oriented substantially in the horizontal direction. Thus, the contact member 86 presses the developer cartridge 20 by an urging force from the compression spring 87. Then, the developer roller 26 is pressed against the photosensitive drum 21, so that the nip portion is formed between the developer roller 26 and the photosensitive drum 21. Accordingly, a toner image can be formed on the surface of the photosensitive drum 21 by the toner supplied by the developer roller 26.

Then, as shown in FIG. 9, when the process cartridge 19 is being separated from the body casing 2, the boss 88 is guided downward by the contact guide groove 89 while the rotating member 84 rotates about the rotating shaft 83. Then, the contact member 86 of the cartridge pressing portion 71 and the developer cartridge 20 are separated from each other (an uncontacted state), and the nip between the photosensitive drum 21 and the developer roller 26 can be released.

With this structure, when the process cartridge 19 is being detached from the body casing 2, the boss 88 of the rotating member 84 is guided by the contact guide groove 89, provided in the body casing 2, and the rotating member 84 rotates about the rotating shaft 83. Thus, the contact between the contact member 86 and the developer cartridge 20 is released. With this structure, the contact between the contact member 86 and the developer cartridge 20 can be disengaged in synchronization with the detachment of the process cartridge 19 from the body casing 2.

The shape of the guide grooves 79 are not limited to the above-described embodiment. The guide grooves 79 may have various shapes in accordance with the other parts or members provided in the installation/removal path of the process cartridge 19 in the image forming apparatus.

According to the exemplary embodiments, when the process cartridge is attached to and detached from the image forming apparatus, the image holding body can be moved by the supporting device in a direction such that it approaches and moves away from the transfer device. Therefore, the interference between the image holding body and the members disposed in the process cartridge installation/removal path or opening can be prevented by the movement of the image holding body. Accordingly, the installation/removal path or opening can be reduced in size in the direction in which the image holding body and the transfer device oppose each other. Thus, the process cartridge can be downsized and can be attached to and detached from the image forming apparatus while requiring less space in the image forming apparatus.

The shaft of the image holding body is supported by the elongated hole of the shaft receiving portion so as to be movable in the longitudinal direction of the elongated hole. Accordingly, the image holding body can be easily moved by the simple structure. In addition, the installation/removal path or opening can be reduced in size in the direction in which the image holding body and the transfer device are opposite to each other.

The process cartridge is attached to and detached from the image forming apparatus while the guided portion of the process cartridge is guided by the guiding portion of the image forming apparatus. Therefore, the process cartridge can be attached to and detached from the image forming apparatus.

The elongated hole of the shaft receiving portion extends in a direction substantially perpendicular to the process cartridge attaching/detaching direction, so that the image holding body can be moved in the direction substantially perpendicular to the process cartridge attaching/detaching direction. Therefore, interference between the members disposed in the installation/removal path or opening and the image holding body during attachment/detachment of the process cartridge can be reduced, and preferably prevented.

The image holding body is supported by the second frame so as to be integrally movable with the first frame. That is, the image holding body moves together with the first frame. Accordingly, a space for moving the image holding body need not be provided in the first frame. Thus, the process cartridge can be downsized while still protecting the photosensitive drum 21 from damage that can occur to the image holding member during attachment/detachment thereof to the image forming apparatus and/or during storage and handling of the process cartridge.

The acting device is provided on the first frame accommodating the image holding body, so that the precise relative positional relationship between the acting device and the image holding device can be maintained.

The acting device includes the charging device, so that the precise relative positional relationship between the charging device and the image holding body can be maintained. Accordingly, at least based on the positional relationship, it is ensured that the image holding body can be charged by the charging device.

The acting device includes the cleaning device, so that the precise relative positional relationship between the cleaning device and the image holding device can be maintained.

The restricting device restricts the first frame from rotating with respect to the second frame, so that the posture of the first frame with respect to the second frame can be maintained, and the process cartridge can be attached to and detached from the image holding device.

The rotation of the first frame with respect to the second frame can be easily restricted by the protrusions of the first frame. The protrusions of the first frame engage with the grooves of the second frame.

When the process cartridge is detached from the image forming apparatus, the image holding body is urged toward the interior of the second frame at all times. Therefore, the exposure of the image holding body to the outside of the second frame can be minimized in order to help protect the image holding body from damage thereto. When the process cartridge is attached to the image forming apparatus, the first frame and the second frame are urged closer together in order to expose the image holding body. Thus, the size of the process cartridge can be reduced. In addition, the installation/removal path or opening can be reduced in size in the image forming apparatus.

The developing agent holding body and the image holding body are pressed against each other by the nip forming device, so that the developing agent holding body can reliably supply developing agent to the image holding body in order to form a developing agent image on the image holding body.

The image forming apparatus accommodates an attachable/detachable process cartridge, which requires a reduced amount of space in the image forming apparatus, so that the image forming apparatus can be downsized.

The nip formed between the image holding body and the developing agent holding body can be released by the nip release device. Therefore, the image holding body can be moved by releasing the nip between the image holding body and the developing agent holding body when the process cartridge is to be attached to and detached from the image forming apparatus.

When the openable member is open, the first elastic member and the housing are separated from each other, so that the process cartridge can be attached to and detached from the process cartridge while the image holding body is easily moved. When the openable member is closed, the first elastic member contacts the housing, so that the developing agent holding member is pressed against the image holding body to form the developing agent image on the image holding body. As described above, by synchronizing the opening and closing of the openable member with the application and release of the pressure by the first elastic member, respectively, functioning of the image forming apparatus can be improved.

When the process cartridge is being detached from the image forming apparatus, the boss of the second elastic member is guided by the groove of the image forming apparatus and the second elastic member rotates about the rotating shaft to separate the second elastic member from the housing. Thus, in synchronization with the detachment of the process cartridge from the image forming apparatus, the second elastic member can be separated from the housing.

The image forming apparatus includes the guiding portion. The guiding portion guides the attachment and detachment of the process cartridge with respect to the image forming apparatus, so that the process cartridge can be easily attached to and the detached from the image forming apparatus.

The guiding portion includes the guide groove. When the process cartridge is attached to and detached from the image forming apparatus, the shaft of the image holding body is guided by the guide grooves. Accordingly, the process cartridge can be easily attached to and detached from the image forming apparatus by the simple structure.

When the process cartridge is attached to and detached from the image forming apparatus, the guiding portion guides the movement of the image holding body so as to prevent the interference between the guiding member and image holding body. Accordingly, the recording medium can be easily guided between the image holding body and the transfer device and the process cartridge can be attached to and detached from the image forming apparatus while the interference between the guiding member and the image holding body.

While this invention has been described in conjunction with the exemplary embodiments outlined above, various alternatives, modifications, variations, improvements and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. A process cartridge, comprising:

a main frame including a first side wall and a second side wall;

an image carrying member supported by the first side wall and the second side wall in a manner that permits the image carrying member to rotate; and an urging device urging the image carrying member toward a retracted position;

wherein:

the process cartridge is capable of being removably attached to an image forming apparatus;

the image carrying member is movable between the retracted position and an extended position;

when viewed from the first side wall side or the second side wall side, the image carrying member is concealed by the first side wall or the second side wall in the retracted position;

when viewed from the first side wall side or the second side wall side, at least a portion of the image carrying member extends beyond a periphery of the first side wall or the second side wall in the extended position;

the urging device urges the image carrying member by applying a force that urges a secondary frame into communication with the main frame; and the urging device is a compression spring extending between and connecting the main frame to the secondary frame.

2. The process cartridge of claim 1, wherein:

the image carrying member is supported on a shaft, the shaft including first and second end projections;

the first side wall is provided with a first side wall opening and the second side wall is provided with a second side wall opening;

the first end projection is positioned in the first side wall opening and the second end projection is positioned in the second side wall opening; and each of the side wall openings has an oblong shape, such that the respective end projection can be moved from a first position in the respective side wall opening corresponding to the retracted position of the image carrying member and a second position corresponding to the extended position of the image carrying member.

3. The process cartridge of claim 2, wherein the secondary frame supports the image carrying member and moves with the image carrying member when the image carrying member moves between the retracted position and the extended position.

4. The process cartridge of claim 3, wherein the main frame is provided with a rotation preventing device that prevents the secondary frame from rotating with respect to the main frame, while allowing the secondary frame to move as the image carrying member moves between the retracted position and the extended position.

5. The process cartridge of claim 4, wherein the rotation preventing device comprises an engagement projection provided on the secondary frame and an engagement groove provided on the main frame.

6. The process cartridge of claim 5, wherein the engagement groove extends in a direction corresponding to a direction in which the image carrying member moves between the retracted position and the extended position.

7. The process cartridge of claim 3, wherein the process cartridge is provided with a charging device, provided on the secondary frame, that charges the image carrying member.

8. The process cartridge of claim 3, wherein the process cartridge is provided with a cleaning device, provided on the secondary frame, that cleans the image carrying member.

9. The process cartridge of claim 1, further comprising a developer cartridge including a toner and a developer roller for dispensing toner, the developer cartridge being capable of being installed in an image forming apparatus.

10. The process cartridge of claim 9, further comprising a nip forming device, the nip forming device urging the developer roller into contact with the image carrying member when the process cartridge is installed in the image forming apparatus.

11. The process cartridge of claim 10, wherein the nip forming device includes a spring loaded member that presses the developer cartridge toward the image carrying member.

12. A process cartridge, comprising:

a main frame including a first side wall and a second side wall;

an image carrying member supported by the first side wall and the second side wall in a manner that permits the image carrying member to rotate, the image carrying member including a first end projection and a second end projection, the first end projection and the second end projection extending from a first end and a second end, respectively, of the image carrying member; and an urging device urging the first end projection and the second end projection toward one of a first position and a second position;

wherein:

the process cartridge is capable of being removably attached to an image forming apparatus;

the first side wall includes a first support opening and the second side wall includes a second support opening, each support opening supporting a respective one of the first end projection and the second end projection;

each of the first support opening and the second support opening having a shape that permits the respective first end projection and second end projection to move between the first position and the second position;

the image carrying member is exposed from the main frame at the first position and is covered with the main frame at the second position;

the urging device urges the first end projection and the second end projection by applying a force that urges a secondary frame into communication with the main frame; and the urging device is a compression spring extending between and connecting the main frame to the secondary frame.

13. The process cartridge of claim 12, wherein each of the side wall openings has an oblong shape.

14. The process cartridge of claim 13, wherein the secondary frame supports the first end projection and the second end projection and moves with the first end projection and the second end projection between the first position and the second position.

15. The process cartridge of claim 14, wherein the process cartridge is provided with a charging device, provided on the secondary frame, that charges the image carrying member.

16. The process cartridge of claim 13, wherein the process cartridge is provided with a cleaning device that cleans the image carrying member.

17. The process cartridge of claim 16, wherein the cleaning device is provided on the secondary frame.

18. The process cartridge of claim 12, wherein the main frame is provided with a rotation preventing device that prevents the secondary frame from rotating with respect to the main frame, while allowing the secondary frame to move as the first end projection and the second end projection move between the first position and the second position.

19. The process cartridge of claim 18, wherein the rotation preventing device comprises an engagement projection provided on the secondary frame and an engagement groove provided on the main frame.

20. The process cartridge of claim 19, wherein the engagement groove extends in a direction corresponding to a direction in which the first end projection and the second end projection move between the first position and the second position.

21. The process cartridge of claim 12, further comprising a developer section including a toner and a developer roller for dispensing toner.

22. The process cartridge of claim 21, wherein the developer section is a removable developer cartridge.

23. The process cartridge of claim 22, further comprising a nip forming device, the nip forming device urging the developer roller into contact with the image carrying member when the process cartridge is installed in an image forming apparatus.

24. The process cartridge of claim 23, wherein the nip forming device includes a spring loaded member that presses the developer cartridge toward the image carrying member.

25. An image forming apparatus, comprising:

a casing supporting a transfer device;

a process cartridge, capable of being removably attached to the image forming apparatus, including a first side wall and a second side wall and supporting an image carrying member, the image carrying member being in contact with the transfer device when the process cartridge is installed in the casing; and an urging device urging the image carrying member toward a retracted position;

wherein:

the image carrying member is movable between the retracted position and an extended position;

when viewed from the first side wall side or the second side wall side, the image carrying member is concealed by the first side wall or the second side wall in the retracted position;

when viewed from the first side wall side or the second side wall side, at least a portion of the image carrying member extends beyond a periphery of the first side wall or the second side wall in the extended position;

the casing includes an engagement structure that causes the image carrying member to move from the retracted position to the extended position as the process cartridge is installed in the image forming apparatus;

the urging device urges the image carrying member by applying a force that urges a secondary frame into communication with a main frame; and the urging device is a compression spring extending between and connecting the main frame to the secondary frame.

26. The image forming apparatus of claim 25, wherein:

the image carrying member is supported on a shaft, the shaft having first and second end projections;

the first side wall is provided with a first side wall opening and the second side wall is provided with a second side wall opening;

the first end projection is positioned in the first side wall opening and the second end projection is positioned in the second side wall opening; and each of the side wall openings has an oblong shape, such that the respective end projection can be moved from a first position in the opening corresponding to the retracted position of the image carrying member and a second position corresponding to the extended position of the image carrying member.

27. The image forming apparatus of claim 26, wherein:

the engagement structure includes a first engagement channel and a second engagement channel;

the first end projection and the second end projection are movably fitted into the first engagement channel and the second engagement channel, respectively; and the first engagement channel and the second engagement channel are configured such that, as the process cartridge is installed into the image forming apparatus, the first end projection and the second end projection are each moved from the first position to the second position.

28. The image forming apparatus of claim 25, wherein the process cartridge further comprises a removable developer cartridge including a toner and a developer roller capable of dispensing the toner.

29. The image forming apparatus of claim 28, further comprising a nip forming device, the nip forming device urging the developer roller into contact with the image carrying member when the process cartridge is installed in the image forming apparatus.

30. The image forming apparatus of claim 29, wherein the nip forming device includes a spring loaded member that presses the developer cartridge toward the image carrying member.

31. The image forming apparatus of claim 29, wherein:

the image forming apparatus includes a front door through which the process cartridge is installed in/removed from the image forming apparatus;

the nip forming device is provided on the front door; and opening the front door causes the nip forming device to cease urging the developer roller into contact with the image carrying member.

32. The image forming apparatus of claim 30, wherein:

the spring loaded member includes a guide protrusion;

the casing includes a guide channel that receives the guide protrusion;

when the process cartridge is installed into the image forming apparatus, the guide channel guides the guide protrusion to cause the spring loaded member to press the developer cartridge toward the image carrying member; and when the process cartridge is removed from the image forming apparatus, the guide channel guides the guide protrusion to cause the spring loaded member to disengage and cease pressing the developer cartridge toward the image carrying member.

33. An image forming apparatus, comprising:

a casing including an installation path;

a process cartridge, capable of being removably attached to the image forming apparatus, including a first side wall, a second side wall and an image carrying member supported by the first side wall and the second side wall in a manner that permits the image carrying member to rotate; and an urging device urging the image carrying member toward a first position;

wherein:

the image carrying member has a first end projection and a second end projection, the first end projection and the second end projection extending from a first end and a second end, respectively, of the image carrying member;

the first side wall includes a first support opening and the second side wall includes a second support opening, each support opening supporting a respective one of the first end projection and the second end projection;

each of the first support opening and the second support opening has a shape that permits the respective first end projection and second end projection to move between the first position and a second position; and the installation path includes a first guide groove and a second guide groove that guide the respective first end projection and second end projection from the first position to the second position as the process cartridge is moved along the installation path during installation;

the urging device urges the image carrying member by applying a force that urges a secondary frame into communication with a main frame; and the urging device is a compression spring extending between and connecting the main frame to the secondary frame.

34. The image forming apparatus of claim 33, wherein the process cartridge further comprises a removable developer cartridge including a toner and a developer roller capable of dispensing the toner.

35. The image forming apparatus of claim 34, further comprising a nip forming device, the nip forming device urging the developer roller into contact with the image carrying member when the process cartridge is installed in the image forming apparatus.

36. The image forming apparatus of claim 35, wherein:

the image forming apparatus includes a front door through which the process cartridge is installed in/removed from the image forming apparatus;

the nip forming device is provided on the front door; and opening the front door causes the nip forming device to cease urging the developer roller into contact with the image carrying member.

37. The image forming apparatus of claim 35, wherein the nip forming device includes a spring loaded member that presses the developer cartridge toward the image carrying member.

38. The image forming apparatus of claim 37, wherein:

the spring loaded member includes a guide protrusion;

the casing includes a guide channel that receives the guide protrusion;

when the process cartridge is installed into the image forming apparatus, the guide channel guides the guide protrusion to cause the spring loaded member to press the developer cartridge toward the image carrying member; and when the process cartridge is removed from the image forming apparatus, the guide channel guides the guide protrusion to cause the spring loaded member to disengage and cease pressing the developer cartridge toward the image carrying member.

39. A process cartridge, comprising:

a main frame including a first side wall and a second side wall;

an image carrying member supported by the first side wall and the second side wall in a manner that permits the image carrying member to rotate; and an urging device urging the image carrying member toward a retracted position;

wherein:

the process cartridge is capable of being removably attached to an image forming apparatus;

the image carrying member is movable between the retracted position and an extended position;

when the image carrying member is in the retracted position, at least a portion of at least one of the first side wall and the second side wall projects beyond a first pair and a second pair of diametrically opposing points along an outer circumference of a side of the image carrying member, the first pair of diametrically opposing points forming a first line that is substantially perpendicular to a second line formed by the second pair of diametrically opposing points;

when viewed from the first side wall side or the second side wall side, at least one of the diametrically opposing points of the image carrying member extends beyond a periphery of the first side wall or the second side wall in the extended position;

the urging device urges the image carrying member by applying a force that urges a secondary frame into communication with the main frame; and the urging device is a compression spring extending between and connecting the main frame to the secondary frame.

40. An image forming apparatus, comprising:

a casing supporting a transfer device;

a process cartridge, capable of being removably attached to the image forming apparatus, including a first side wall and a second side wall and supporting an image carrying member, the image carrying member being in contact with the transfer device when the process cartridge is installed in the casing; and an urging device urging the image carrying member toward a retracted position;

wherein:

the image carrying member is movable between the retracted position and an extended position;

when viewed from the first side wall side or the second side wall side, at least diametrically opposing points along an outer circumference of a side of the image carrying member are concealed by the first side wall or the second side wall in the retracted position, the diametrically opposing points forming a line that is substantially perpendicular to an attachment/detachment path of the image forming apparatus;

when viewed from the first side wall side or the second side wall side, at least one of the diametrically opposing points of the image carrying member extends beyond a periphery of the first side wall or the second side wall in the extended position; and the casing includes an engagement structure that causes the image carrying member to move from the retracted position to the extended position as the process cartridge is installed in the image forming apparatus;

the urging device urges the image carrying member by applying a force that urges a secondary frame into communication with a main frame; and the urging device is a compression spring extending between and connecting the main frame to the secondary frame.

* * * * *